US006193566B1

(12) United States Patent
Isobe et al.

(10) Patent No.: US 6,193,566 B1
(45) Date of Patent: Feb. 27, 2001

(54) TERMINAL DEVICE

(75) Inventors: Masashi Isobe; Masatake Yamano, both of Osaka (JP)

(73) Assignee: Idec Izumi Corporation, Osaka (JP)

( * ) Notice: Subject to any disclaimer, the term of this patent is extended or adjusted under 35 U.S.C. 154(b) by 0 days.

(21) Appl. No.: 08/945,709

(22) PCT Filed: Feb. 28, 1997

(86) PCT No.: PCT/JP97/00634

§ 371 Date: Apr. 20, 1998

§ 102(e) Date: Apr. 20, 1998

(87) PCT Pub. No.: WO97/32361

PCT Pub. Date: Sep. 4, 1997

(30) Foreign Application Priority Data

Feb. 29, 1996 (JP) ..... 8-42981
Feb. 29, 1996 (JP) ..... 8-42982

(51) Int. Cl.[7] ..... H01R 4/30
(52) U.S. Cl. ..... 439/801; 439/782
(58) Field of Search ..... 439/709, 813, 439/781, 801, 782

(56) References Cited

U.S. PATENT DOCUMENTS 5,376,024 * 12/1994 Sako et al. ..... 439/709

FOREIGN PATENT DOCUMENTS 61-63759 4/1986 (JP) .
6-195595 8/1988 (JP) .
63-105236 8/1988 (JP) .

* cited by examiner

*Primary Examiner*—Neil Abrams
*Assistant Examiner*—Eugene G. Byrd
(74) *Attorney, Agent, or Firm*—Baker & Daniels

(57) ABSTRACT

Disclosed herein is an electric terminal device as featured by providing at one side of a washer for supporting a terminal screw a washer guide section which is bent toward a terminal fixture as mated with the terminal screw and extends in a direction parallel with the axis of such terminal screw while providing a recovery spring between a housing and a midway portion in back of the washer guide section (at the opposite side to the terminal screw), wherein where no lead wires are implemented therein, it is possible to let the device be in the recovered state due to presence of the recovery-spring force thus enabling a lead wire to be directly inserted into a gap above the terminal fixture; conversely, where the wire is to be taken out of it, unlocking the terminal screw may permit automatic recovery at the recovered state due to application of the recovery spring force. This may reduce complexity of required wiring works while increasing wiring-work efficiency even during close-contact attachment of the device.

19 Claims, 18 Drawing Sheets

PRIOR ART

PRIOR ART

TERMINAL DEVICE

TECHNICAL FIELD

The present invention relates to terminal devices use in electrical equipment including control equipment such as push buttons, selector switches, indicator lamps and the like, or terminal devices with a built-in transformer adaptable or the like for use in said control apparatus.

BACKGROUND ART

A prior art push-button switch is shown in FIG. 1. A contact section 102 is coupled in back of a push button operation section 101, wherein this contact section 102 is provided with terminal metal fixtures 103, 103 electrically connected to a fixed contact and a movable contact, and washer-attached terminal screws 104, 104 as mated therewith.

Also, a prior known transformer-attached indicator lamp is shown in FIGS. 2 and 3. A transformer section 122 is coupled in back of an indicator section 121, and a terminal section 123 is coupled in further back of it. As shown in FIG. 3, terminal fixtures 124, 125 electrically connected to the primary winding of a transformer are provided at the right and left sides of a substantially square back surface and symmetrical with respect to the center point, wherein terminal screws 126, 127 are disposed at diagonally opposing corners for being mated with threaded holes of the terminal fixtures 124, 125. These terminal screws 126, 127 are provided to be rotatable relative to square washers 128, 129 but not detachable therefrom, and also arranged so that the terminal fixture portions opposing such washers 128, 129 are exposed from a terminal section housing.

In these prior art devices, where the terminal screw 104 of the contact section 102 or the terminal screws 126, 127 of terminal section 123 are connected with ring-like contact-bonding terminal-attached lead wires by way of example, it is required that the terminal screw 104 or screws 126, 127 be completely unlocked for release and then mated again. This would result in an increase in wiring process step number while simultaneously raising a risk of occurrence of electrical shorting of circuitry at drop-out portions due to missing of terminal screws and/or dropping down thereof, which disadvantageously serves to further increase difficulty in screwing the washer-attached terminal screws into corresponding terminal fixtures when sufficient spaces are not present near or around them.

Seeing the prior art technology as to terminal base plates for mere connection between lead wires by extending the technical field, Japanese Patent Publication No. 4-11988 or Japanese Utility Model Registration Publication No. 3-7031 discloses therein a terminal base having terminal fixture with a vertical piece integrally provided therewith and a coil spring (recovery spring) as disposed between the distal end of such vertical piece and a housing.

When the automatic recovery structure of such terminal bases is adapted for use with terminal devices as employed in control elements such as push button switches and the like, positioning of the coil spring at the lower part of the vertical piece requires use of certain space corresponding to the length of coil spring compressed, which results in an increase in height of the contact section—in other words, the terminal section increases its depth dimension. This disadvantageously serves to much reduce the product value of control elements which have received strong demands for miniaturization. In addition, each coil spring must be laterally inserted during fabrication while forcing it to be compressed thus increasing complexity of assembly works, which in turn renders difficult automation of assembly.

The above Japanese Utility Model Publication No. 3-7031 also discloses therein another terminal base structure which includes a compression coil spring as provided on the front side (terminal screw side) of a terminal fixture, and an insertion section for support of the center portion of such coil spring, which section is arranged to penetrate through the terminal fixture from the front to the back side thereof thereby supporting an associated terminal screw.

However, the automatic recovery structure of this terminal base is faced with problems which follow: Where this device is adapted for use in controller elements, resultant structure is increased in total depth dimension due to the fact that the insertion section projects toward the back side of the terminal fixture when a terminal screw is locked; furthermore, a connection lead wire or contact-bonding terminal can be accidentally clipped between adjacent twisted wires of the coil spring due to exposure of the coil spring on the surface of such terminal fixture.

A further terminal base is disclosed in Published Unexamined Japanese Utility Model Registration Application No. 2-27666, which base is structured as shown in FIG. 4, wherein a washer guide section 112 is provided by bending downwardly a lower vertical elongate piece formed at one side of a washer supporting at its neck section a terminal screw 110 and is arranged to penetrate a terminal fixture 111 from its upper to lower side. The the coil section of a torsion coil spring (recovery spring) 114 is attached for support of spring 114 to each shaft 113 formed beneath the terminal fixture with its one free edge being engaged with the lower end of washer guide section 112.

The prior art suffers from a problem in that when the automatic recovery structure is adapted for use in terminal devices as employed in controller elements such as push button switches and the like, assembly works are difficult rendering automation likewise difficult due to the necessity of attaching the coil section of each torsion coil spring 114 to its associated shaft 113 and then engaging it with the lower end of the washer guide section 112 while pushing the torsion coil spring 114 for resilient displacement. Another problem is that the resulting depth size is enlarged since the torsion coil spring 114 is disposed beneath the terminal screw 110 and located on an extension line from the axis direction of terminal screw 110.

In the recent years a finger protect structure is increasing in importance more and more for use in control elements or control equipment. This refers to a specific structure for protection by use of dielectric materials to suppress an accidental finger touch in view of the fact that if electrically conductive then current-carrying portions such as head sections of terminal screws are exposed raising a risk of occurrence of electrical shocks.

One prior art approach to such finger protect structure is shown in FIG. 5 by way of example, wherein a detachable finger protect cover 106 is attached onto a contact section main body 105 so as to cover terminal screws 104. Another approach is depicted in FIG. 6, wherein finger protect pieces 108, 108 are rigidly attached by adhesive so as to cover the head sections of terminal screws 104, 104 of a contact section main body 107. Unfortunately, any one of these approaches suffers from an increase in parts number as a whole; especially, the former approach of employing the finger protect cover 106 is associated with a problem in that the finger protect cover 106 can drop down and that attachment thereof might be forgotten after once taken out.

Accordingly, an object of the present invention is to provide a terminal device capable of avoiding the foregoing problems encountered with the prior art, more particularly a terminal device capable of easily attaining automatization based on the fact that while it has an automatic recovery structure for eliminating drop-down of washer-attached terminal screws while forcing them—when unlocked—to be automatically spaced apart from terminal fixtures, the device does not increase in depth size as a whole, and yet capable of being assembled merely by putting into a specified space without having to apply in advance pressure to a recovery spring during assembly.

DISCLOSURE OF THE INVENTION

A terminal device of this invention offers several features which follow.

(1) A terminal device characterized by providing at one side of a washer supporting a terminal screw a washer guide section being bent toward a terminal fixture mated with the terminal screw while extending in parallel with the axis of said terminal screw, and in that a recovery spring is provided between a housing and a midway portion in back of the washer guide section (at the opposite side to said terminal screw)

(2) A terminal device characterized by having a washer-attached terminal screw, a band-like terminal fixture for connection between a female screw mated with the terminal screw and a switching contact, a washer guide section intersecting the terminal fixture along the side edge of the terminal fixture with one side of the washer being bent toward the terminal fixture, and a torsion coil spring (recovery spring) as provided between the distal end portion of the washer guide section and a housing, and in that the terminal screw has its trunk section held on the back side of a housing partition wall dividing the thickness direction of the terminal device into two portions while allowing the torsion coil spring to be held on the front side thereof.

(3) A terminal device characterized in that a terminal-side housing is additionally provided in back of a main body-side housing of electrical equipment, in that the terminal-side housing is provided with a containment space for a terminal fixture mated with a terminal screw, a washer guide groove for guidance of a washer supporting the terminal screw, a recovery compression coil spring containment space, and a finger protect section which are integrally formed together, and in that the washer is integrally formed with a washer guide section slidably associated with the washer guide groove and a spring pressing section projecting into the inside of the recovery compression coil spring containment space.

(4) A terminal device characterized in that a terminal-side housing is additionally provided in back of a main body-side housing of electrical equipment, in that the terminal-side housing is provided with a containment space for a terminal fixture as mated with a terminal screw, a washer guide groove for guidance of a washer supporting the terminal screw, a recovery torsion coil spring containment space, and a finger protect section as integrally formed together, in that the washer is provided with a washer guide section as integrally formed therewith to slidably move along the washer guide groove, and in that a spring stopper section is provided for causing a movable end of the recovery torsion coil spring to be fixed at the washer guide section.

The terminal device (1) of the invention is such that the recovery spring is a compression coil spring, a main body housing acting as the housing-side acceptor section of the compression coil spring and a housing main body are constituted to be engageable with each other and may also be structured so that the compression coil spring is compressed by letting the coil spring be attached to the main body housing after its naturally falling down into certain space.

The terminal device (1) of the invention may be structured in a way such that a finger protect section is formed integrally with the housing main body supporting the terminal fixture thereby allowing this finger protect section to also attain a stopper function during discoupling of the terminal screw.

The arrangement in case where the terminal device (1) of the invention is applied to control equipment is such that the device essentially consists of a prestage section including an operation section or equivalents thereto and a contact section detachably coupled to the prestage section, wherein its contact section includes an electrical contact, a terminal fixture conducted with the electrical contact, a terminal screw mated with the terminal fixture, a transmitter member for performing contact opening and closing in response to operations of the operation section, a housing main body holding therein these respective members, and a main body casing attached to the housing main body and including a front face wall in contact with the prestage section, characterized by providing at one side of a washer supporting the terminal screw a washer guide section which is bent toward the terminal fixture and extends in parallel with the axis of the terminal screw, providing a stopper section at the washer guide section, and providing a recovery spring between the stopper section and the front face wall.

With the terminal device (2) of the invention, since the recovery force of the torsion coil spring acts to continuously press the washer guide section causing the terminal screw to be discoupled therefrom, once the terminal screw is unlocked letting it become free from mating with the female screw, the terminal screw is immediately released out of the terminal fixture whereby an opening is defined for insertion of a lead wire. At this time, it will no longer occur that the terminal screw drops off because the terminal screw and the washer guide section move together at any event.

In addition, since the washer guide section intersects along the side edge of the terminal fixture, the thickness of that part is equivalent to the sum of the width of the terminal fixture and the thickness of the washer guide section, which may in turn enable the thickness of overall terminal device to remain less than ever. Further, the torsion coil spring is ordinarily less in number of turns to equal to one or a few, less in distance between adjacent windings providing close contact therebetween, and less in retractility of its axis-direction length unlike compression (spiral-shaped) coil springs; accordingly, the width occupying in the thickness direction of the terminal device is rendered compact and hence, it is possible for the terminal device to be minimized in thickness as a whole. Furthermore, under the condition that the terminal screw is tightly locked, the terminal screw becomes maximized in terminal fixture penetration length of the trunk section (screw section) of such terminal screw, which might require an extra space for containment of it; however, this terminal device may be shortened in depth size because the space for this terminal screw and the torsion coil spring containment space are disposed at the opposite sides of the partition wall—that is, on the front and back sides thereof separately.

Regarding the terminal devices (2) of this invention, especially the structure relating to the torsion coil spring as provided on the front side of the partition wall, one noticeable feature is that a projection is provided for allowing the coil section of the torsion coil spring to be attached at a position spaced apart by a predefined distance from a passage for displacement of the washer guide section while forming on the passage side of the projection a slant plane getting lower relative to the partition wall surface.

Furthermore, barriers are formed at two mutually crossing sides forming the boundary of the partition wall surface, wherein the aforesaid projection is provided at the corner thereof, and wherein a through-going hole of the washer guide section and a stopper section for holding the fixed arm section of the torsion coil spring are provided respectively at specified positions of such two barriers, thereby enabling the torsion coil spring to be attached to the space section on this partition wall.

With such an arrangement, the torsion coil spring is forced to go beyond the slant plane to be attached to the projection by merely putting the torsion coil spring on the partition wall surface and sliding it on the surface from the washer guide section passage side toward the projection while causing the torsion coil spring to be manufactured in advance so that its arm length is at a predetermined value; accordingly, it is clamped by the washer guide section distal end portion and the stopper section in operatively responding to such attachment to the projection. This is very important for automation of assembly procedures.

The terminal device (2) of the invention is such that a finger protect section is formed integrally with the housing main body which supports the terminal fixture while allowing this finger protect section to also attain a stopper function during detachment of the terminal screw. This may enable successful control of upward movement of the terminal screw while simultaneously rendering attainable any intended holding of the terminal screw as well as elimination of unwanted dropping down of it.

The configuration where the terminal device (2) of the invention is applied to control equipment is such that it comprises a prestage section such as an operation section or the like and a contact section detachably coupled to the prestage section, wherein the contact section includes an electrical contact, a terminal fixture connected to the electrical contact, a terminal screw mated with the terminal fixture, a transmitter element for performing contact opening and closing in response to operations of the operation section, a housing main body holding therein these respective members, and a main body casing attached to the housing main body and including a front face wall in contact with the prestage section, and is characterized by providing at one side of a washer supporting the terminal screw a washer guide section being bent toward the terminal fixture and extending in parallel with the axis of the terminal screw, providing a torsion coil spring between the distal end portion of the washer guide section and a stopper section of the housing main body, and letting the terminal screw be held on the back side of a housing partition wall subdividing the thickness direction of the terminal device while causing the torsion coil spring to be held in the front side thereof.

In this case it is preferable that the axis direction of the terminal screw is slanted relative to the forward/backward direction of the control equipment—that is, the movement direction of the transmitter element—in a direction in which the screw head section opens.

The terminal device (3) of the invention is characterized by comprising a terminal fixture electrically coupled to a terminal of electrical equipment, a terminal screw mated with the terminal fixture, a combination of washer guide section and spring pressing section as integrally formed with a washer supporting the terminal screw, a terminal-side housing additionally provided in back of a main body-side housing of the electrical equipment, a recovery compression coil spring containment space being formed in parallel with the axis direction of the terminal screw within the terminal-side housing and being opened at its front face (on the main body housing side), a washer guide section formed within the terminal-side housing for guiding the washer guide section in parallel with the axis direction of the terminal screw, and a recovery compression coil spring held in the recovery compression coil spring containment space and having one end as compressed by the spring pressing section.

Preferably, the terminal device (3) of the invention comes with a guide bar provided at the axis center section of the recovery compression coil spring containment space in such a manner that the bar is supported at the back surface of the terminal-side housing to extend forwardly by penetrating the axis center section while allowing its distal end portion to define a free end.

Also preferably, a latch section is formed at the front edge section of the recovery compression coil spring containment space for permitting insertion of the recovery compression coil spring while eliminating escape thereof.

The terminal device (4) of the invention is featured by comprising a terminal fixture electrically coupled to a terminal of electrical equipment, a terminal screw mated with the terminal fixture, a washer guide section as integrally provided with a washer supporting the terminal screw, a terminal-side housing as additionally provided in back of a main body-side housing of the electric equipment, a recovery torsion coil spring containment space opened at the back face of the terminal-side housing, a washer guide groove formed within the terminal-side housing for guiding the washer guide section in parallel with the axis direction of the terminal screw, and a recovery torsion coil spring held in the recovery torsion coil spring containment space and having a fixed arm with its edge portion rested at the terminal-side housing and a movable arm with its edge portion rested at the washer guide section.

In the terminal device (4) of the invention, the coupling relation of the washer guide section versus the recovery torsion coil spring is featured in that one side of the washer is bent at right angles forming a band-shaped washer guide section, that the distal end portion of the movable arm of the recovery torsion coil spring is bent at right angles forming a stopper edge section, and that this stopper edge section penetrates for fixture a cut-away section as formed at the band-shaped washer guide section.

While the terminal devices of the invention will be explained in more detail in conjunction with some illustrative embodiments hereinafter, the invention should not be exclusively limited thereto.

A push button switch having a terminal device which employs a compression coil spring as its recovery spring in accordance with one preferred embodiment of this invention is shown in FIGS. 7 through 12.

Figure 7:
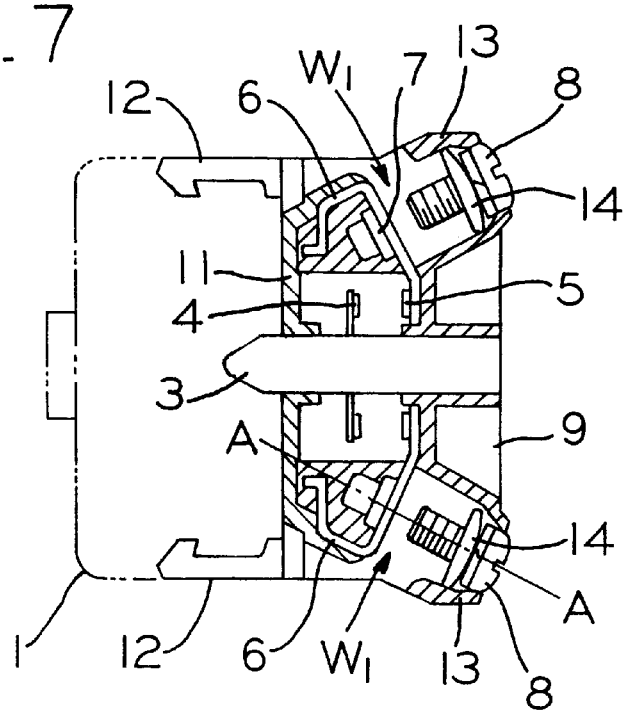
PRIOR ART FIG. 7
FIG. 7 is a diagram showing a cross-sectional view, in a direction along an associative terminal screw, of a terminal device for a push button switch in accordance with one preferred embodiment of the invention.
Figure 8:
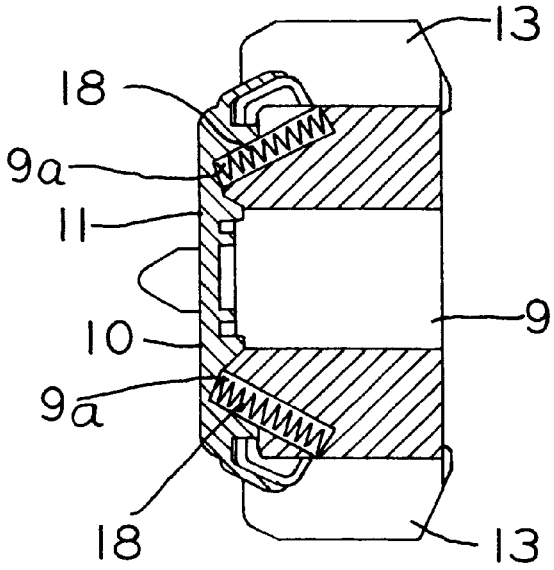
FIG. 8 is a diagram depicting a cross-section of the terminal device of FIG. 7 along a recovery spring thereof.
Figure 9:
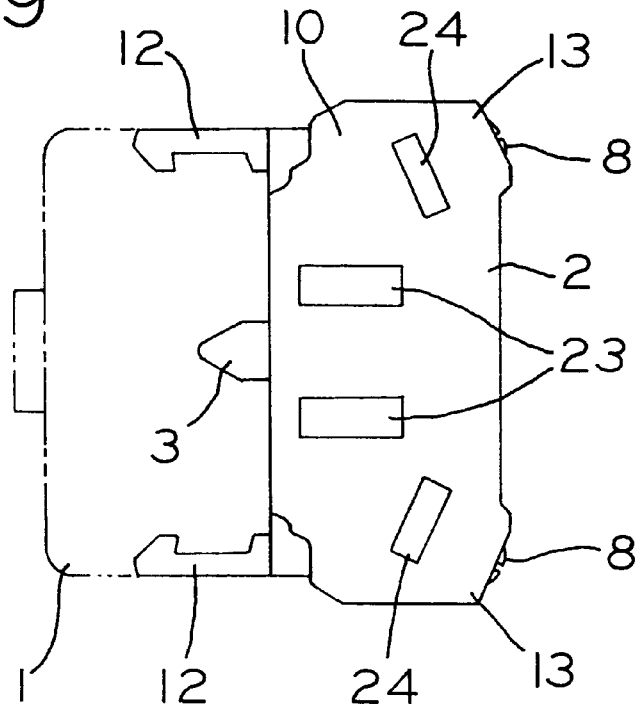
FIG. 9 is a diagram showing an outer appearance of a housing of the terminal device of FIG. 7.
Figure 10:
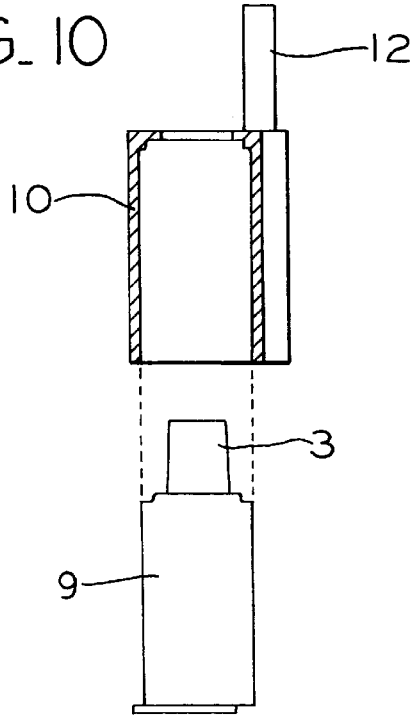
FIG. 10 is a disassembly diagram of a housing main body 9 and main body casing 10 of the terminal device of FIG. 7.
Figure 11A:
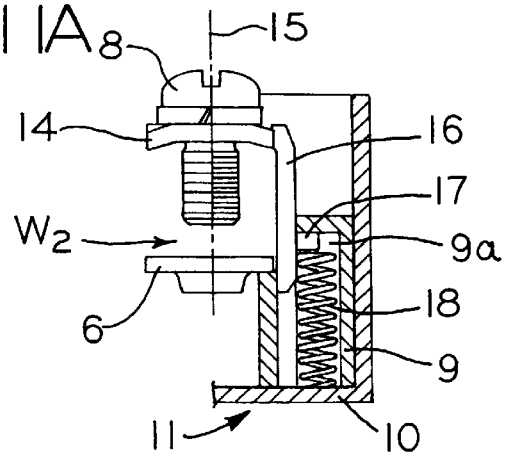
FIG. 11 is a diagram showing a recovery mechanism part of the terminal device of FIG. 7.
Figure 11B:
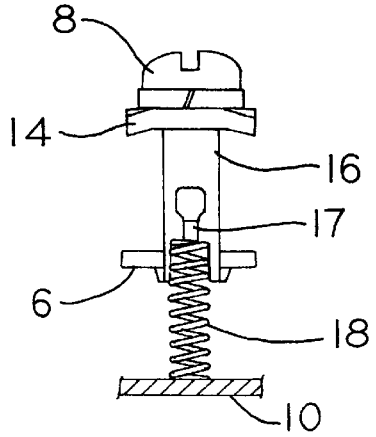
Figure 12A:
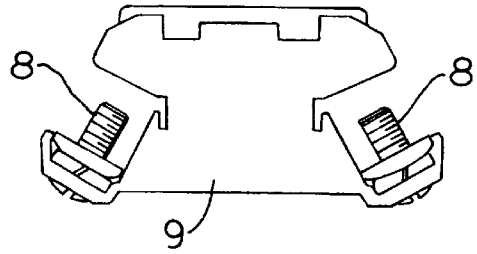
FIG. 12 is a diagram showing the time-sequential assembly process steps of the terminal device of FIG. 7.
Figure 12B:
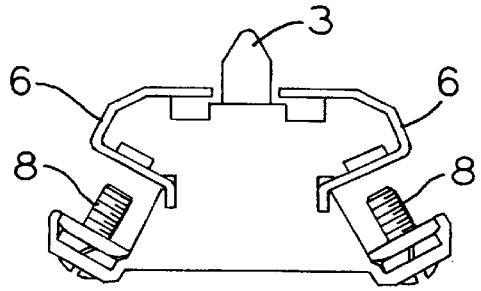
Figure 12C:
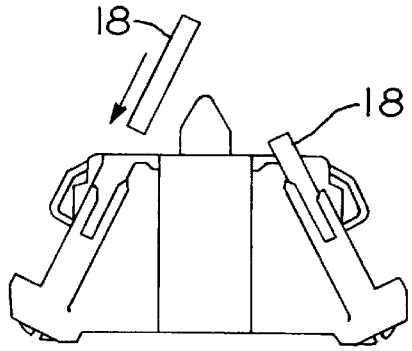
Figure 12D:
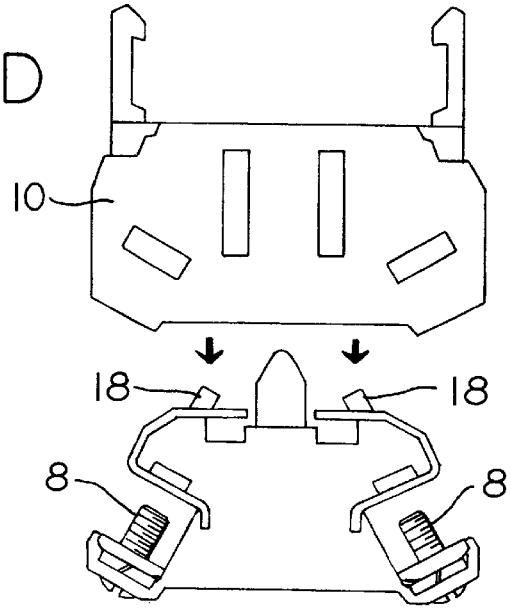

FIG. 7 is a diagram showing a cross-sectional view as taken along the center lines of terminal screws; FIG. 8 is a diagram depicting a cross-sectional view of this embodiment cut along the center line of a coil spring; FIG. 9 is a diagram showing an outer appearance of a housing of this embodiment; FIG. 10 is a diagram showing disassembled configuration of the embodiment before engagement of a main body casing and housing main body together; and, FIG. 11 depicts a positional relationship between one terminal screw and the coil spring, wherein FIG. 11 (A) is a cross-section along line A—A of FIG. 7 whereas FIG. 11 (B) is a diagram showing a side-view structure with the housing removed away.

A contact section 2 is coupled by elastic engagement pieces 12 of casing main body 10 in back of an operation section 1 to ensure that instructions from the operation section 1 are transferred to a transmitter element 3, which is rendered operative in response to an operation of the operation section 1 thereby causing movable contacts 4 to be ON and OFF with respect to fixed contacts 5 associated therewith. Each fixed contact 5 is provided at one end of a terminal fixture 6. A female screw 7 is defined at an emboss section of the terminal fixture 6 for allowing a washer-attached terminal screw 8 to be mated with the female screw 7 with a lead wire terminal being laid between the surface of terminal fixture 6 and a washer 14.

The foregoing respective parts or components are held by a housing main body 9.

As shown in FIG. 10, the housing has a two-divided resilient engageable structure consisting of the housing main body 9 and a main body casing 10 which covers three principal surfaces of the former. The main body casing 10 is provided with, in addition to its both right and left side walls, a front wall 11 as contacted with the operation section 1 and engagement pieces 12, 12 as engageable with the operation section 1. The main body casing 10 also has contact windows 23, 23 for use in checking for the ON/OFF state of the contacts 4, 5, and lead wire insertion holes 24, 24 at selected portions of the both wall sections. Also, finger protect sections 13, 13 are integrally formed with the housing main body 9 for covering the heads of terminal screws 8, 8 while functionally acting also as stoppers. As shown in FIG. 8, coil springs 18, 18 are inserted and held in back of terminal screws 8, 8.

A recovery mechanism of the terminal screws 8 by use of such coil springs 18 will now be explained with reference to FIG. 11. The washer 14 to which one terminal screw 8 is attached is of a square plate shape. A washer guide section 16 is integrally formed with the square washer 14 at the center of one side thereof in a manner such that the washer guide section 16 is bent at right angles toward the terminal fixture 6 and extends in parallel with the axis 15 of the terminal screw having a stopper section 17 being cut and raised from the washer guide section 16 at an intermediate or midway portion of its back side (opposite side to the terminal screw). The length of this washer guide section 16 is equivalent to the length of penetration through the terminal fixture 6 under the recovery condition (the initial state shown in FIG. 7). The coil spring 18 is disposed between the stopper section 17 of washer guide section 16 and the front wall 11 of main body casing 10.

In the housing main body 9, spring containment sections 9*a*, 9*a* are provided at specified positions in back of the washer guide sections 16, 16 of terminal screws 8, 8 in such a way that these extend downwardly (to the terminal screw 8, 8 side) from the plane in contact with the front wall 11 of main body casing 10 of housing main body 9 in parallel with the axes 15, 15 of terminal screws 8, 8. The coil springs 18, 18 are disposed in these containment sections 9*a*, 9*a* in a manner such that certain free ends are brought into contact with the stopper sections 17, 17 of washer guide sections 16, 16 whereas the opposite free ends are in contact with the front wall 11 of main body casing 10. Also, the washer-attached terminal screws 8, 8 are provided in the housing main body 9 such that the stopper sections 17, 17 of washer guide sections 16, 16 are located within the spring containment sections 9*a*, 9*a* while offering upward/downward movability.

A usage of this embodiment is as follows. It can be seen from viewing FIGS. 7 and 11 that in the recovery or "reset" state each terminal screw 8 is spaced apart, together with the washer 14, from the terminal fixture 6 by application of a recovery force of the coil spring 18 thus defining between the distal end of terminal screw 8 and the terminal fixture 6 an opening wide enough to permit insertion of a lead wire or the like therebetween. Additionally, the lead wire or the like may be inserted from either one of the following two perpendicular directions: a direction $W_1$ shown in FIG. 7, or alternatively, a direction $W_2$ shown in FIG. 11. When the terminal screw 8 is locked, the washer guide section 16 and its stopper section 17 are changed in position accordingly (down-going in FIG. 11) causing the coil spring 18 to be compressed. In cases where the terminal screw 8 is unlocked for taking out the lead wire or the like, when the terminal screw 8 is released from the female screw 7 of terminal fixture 6, the recovered state is immediately established due to presence of a recovery force of the coil spring 18.

An assembly procedure sequence of the prescribed embodiment is shown in FIGS. 12 (A) to (D). The washer-attached terminal screws 8, 8 are set to the housing main body 9 (FIG. 12(A)); then, a contact kit including the terminal fixtures 6, 6 and transmitter element 3 is attached thereto (FIG. 12(B)); thereafter, the coil springs 18, 18 are dropped down into specified spaces under natural conditions (FIG. 12(C)); lastly, the main body casing 10 is assembled (FIG. 12(D)) completing the assembly procedure.

Figure 13:
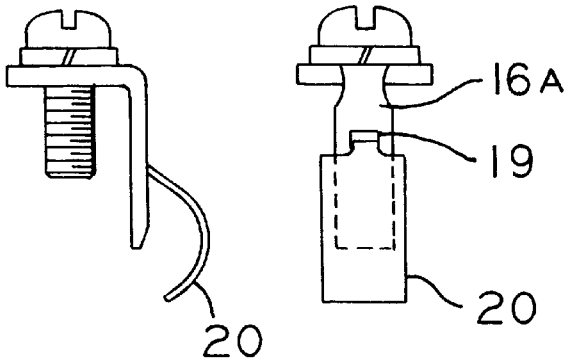
FIG. 13 is a diagram showing another modified embodiment of the recovery spring in the invention.
Figure 14:
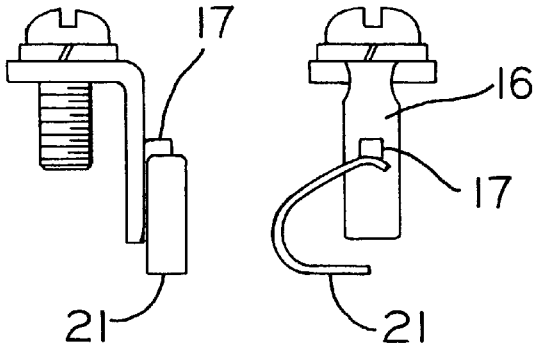
FIG. 14 is a diagram showing a still another modified embodiment of the recovery spring of the invention.
Figure 15:
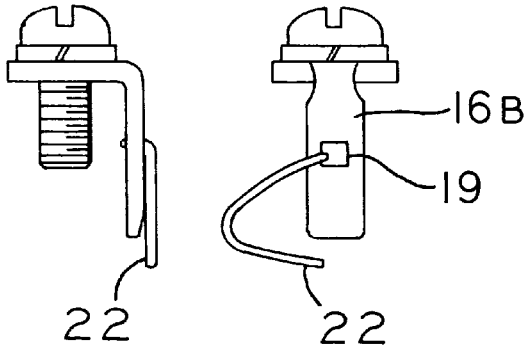
FIG. 15 is a diagram showing a yet another modified embodiment of the recovery spring of the invention.

In this invention the recovery springs for use in the foregoing embodiment should not exclusively be limited only to the illustrative compression springs, and may alternatively be plate springs or wire springs. FIG. 13 illustrates one example in which a stopper hole 19 is defined at a midway portion of a washer guide section 16A with the movable end of a plate spring 20 being inserted into this stopper hole 19. FIG. 14 depicts another example which makes use of the same stopper section-attached washer guide section 16 as that shown in FIG. 11 causing the movable end of a plate spring 21 to rest on this stopper section 17. FIG. 15 shows a further example which employs a stopper hole-defined washer guide section 16B while making use of a U-shaped wire spring 22 as its recovery spring.

Another embodiment is shown in FIGS. 16 to 24 which employs a torsion coil spring as its recovery spring in a terminal device of a push button switch which is similar to that of FIGS. 7 to 12.

Figure 16A:
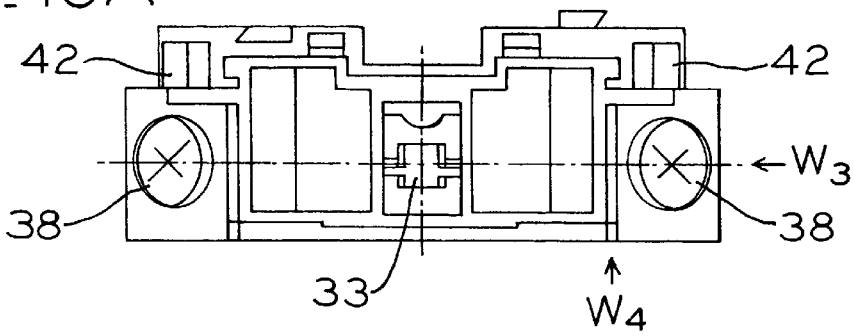
FIG. 16 illustrates outer appearance of a terminal device for use with a push button in accordance with a further embodiment of the invention, wherein (A) is a back side view whereas (B) is a side view thereof.
Figure 16B:
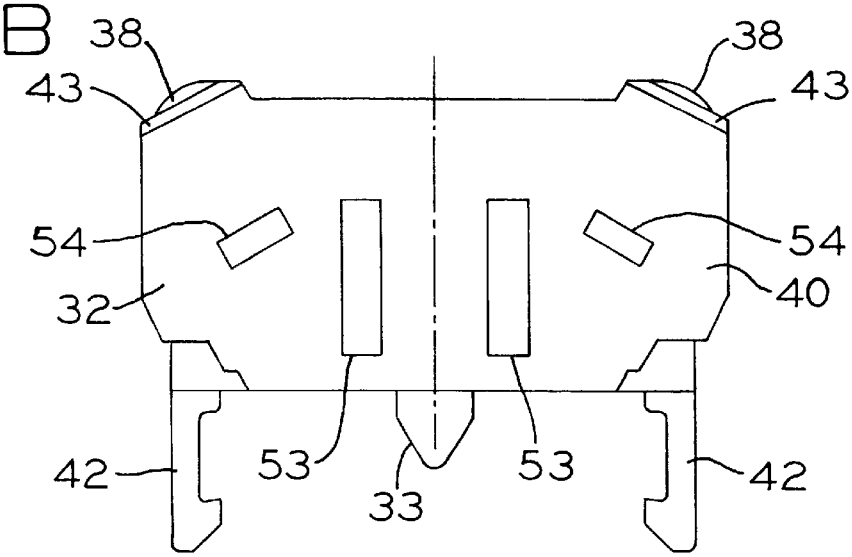
Figure 17:
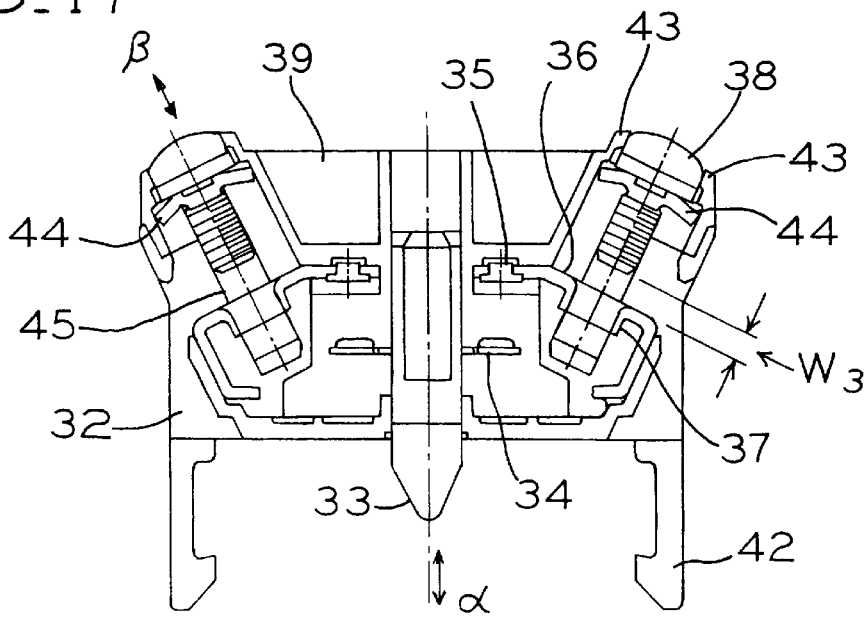
FIG. 17 is a diagram showing a cross-sectional view of the terminal device of FIG. 16.

FIG. 16(A) is its back side view whereas FIG. 16(B) is a side view thereof. Note in FIG. 16(B) that the lower part corresponds to the front side in an ordinary use situation whereas the upper part corresponds to the back side. FIG. 17 is a pictorial representation of a cross-section of a housing as taken along a plane passing through the center lines of two terminal screws 38, 38 at the contact section 32 discussed supra.

A contact section 32 is coupled by elastic engagement pieces 42 of casing main body 40 in back of an operation section 31 to ensure that instructions from the operation section 31 are transferred to a transmitter element 33, which is rendered operative in response to an operation of the operation section 1 thereby causing movable contacts 34 to be ON and OFF with respect to fixed contacts 35 associated therewith. Each fixed contact 35 is provided at one end of a terminal fixture 36. A female screw 37 is formed at an emboss section of the terminal fixture 36 for allowing a washer-attached terminal screw 38 to be mated with the female screw 37 with a lead wire terminal being sandwiched between the surface of terminal fixture 36 and a washer 44. The foregoing respective parts are held by a housing main body 39.

Figure 18:
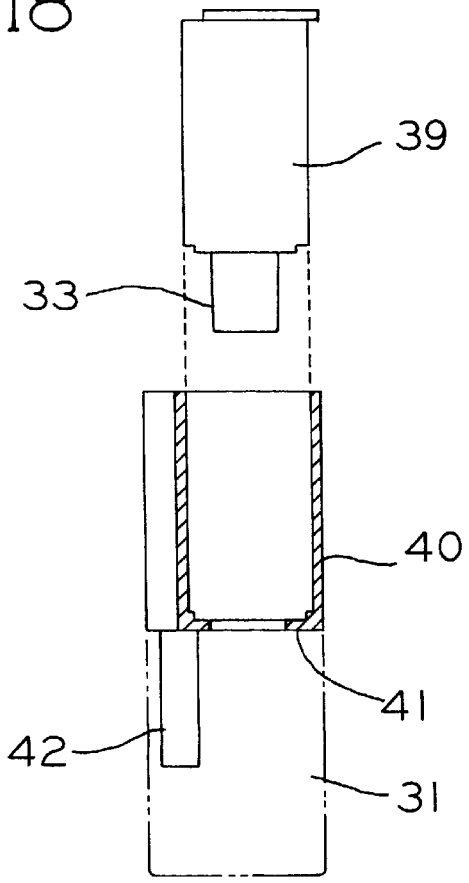
FIG. 18 is a disassembly diagram of a housing main body 39 and main body casing 40 of the terminal device of FIG. 16.

As shown in FIG. 18, the housing has a two-divided resilient engageable structure consisting of the housing main body 39 and main body casing 40 which covers three principal surfaces of the former. The main body casing 40 includes, in addition to its both right and left side walls, a front wall 41 as contacted with the operation section 31 and engagement pieces 42, 42 engageable with the operation section 31. The main body casing 40 also has contact windows 53, 53 for use in checking for the ON/OFF state of the contacts 34, 35 and lead wire insertion holes 54, 54 at selected portions of the both wall sections. Additionally, finger protect sections 43, 43 are integrally formed with the housing main body 39 for covering the heads of terminal screws 38, 38 while acting in function as stoppers, also.

When the operation section 31 turns off, the transmitter element 33 changes in position to move forwardly (downward in the drawing) while allowing the contacts 34, 35 to turn off; when the operation section 31 is operated to turn on, the transmitter element 33 is displaced backwardly causing contacts 34, 35 to turn on. With respect to the movement direction $\alpha$ of this transmitter element 33, the axis directions $\beta,\beta$ of terminal screws 38, 38 are slanted causing the screw head section to open. Such terminal screw axis inclination makes easier driver-tool operations of terminal screws in cases where a plurality of the contact section are to be coupled together while enabling the recovery force of the torsion coil spring to function efficiently as will be described later.

Figure 19:
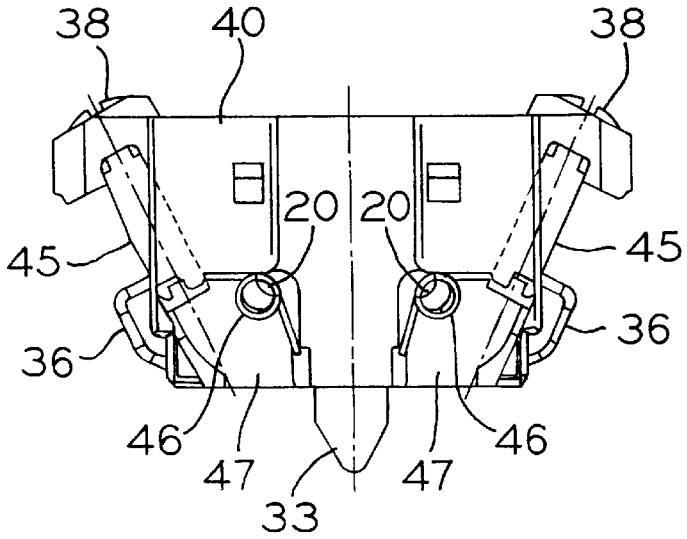
FIG. 19 is a diagram showing a side view of the terminal device of FIG. 16 at the opposite side to that of FIG. 17 with the main body casing 40 removed away.
Figure 20:
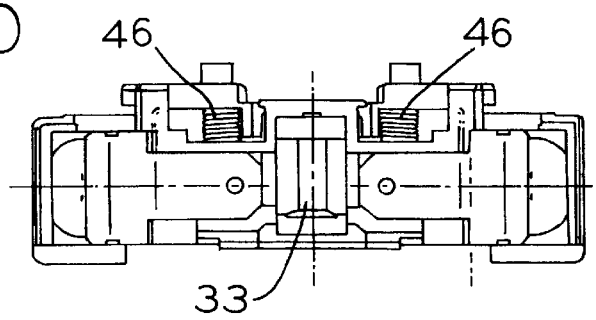
FIG. 20 is an elevational view of the structure shown in FIG. 19.
Figure 21:
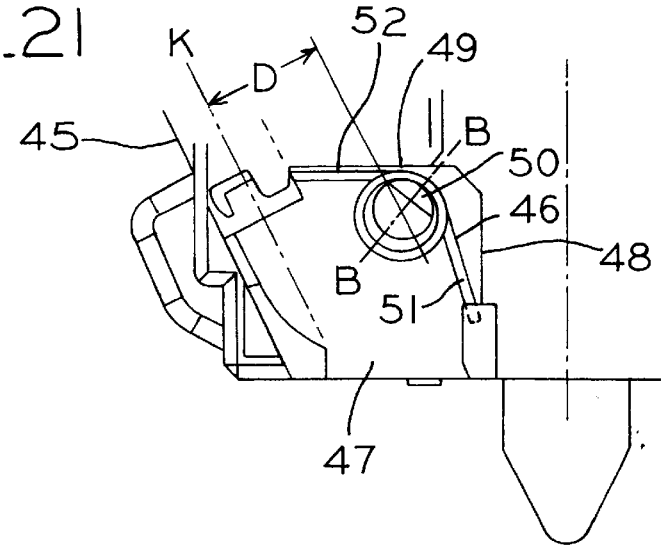
FIG. 21 is a diagram showing an enlarged view of the recovery spring of FIG. 19 along with its nearby section.

FIG. 19 is a diagram showing a side view of the above embodiment at certain side opposite to that of FIG. 17 under the condition that the main body casing 40 is removed away; and, FIG. 20 depicts its elevational view. FIG. 21 is a partly enlarged view of a torsion coil spring and its associated nearby portion, and FIG. 22 illustrates a cross-section as taken along line B—B of FIG. 21.

A down-standing piece is formed at one side (the rear side of a paper in FIG. 17) of a substantially square washer 44 engageable with the heads of terminal screws 38, 38 shown in FIG. 17 in a way such that this piece is bent at right angles toward the terminal fixture 36 in a direction parallel with the axis of terminal screw 38 thereby extending so that it intersects the terminal fixture 36 thus forming a washer guide section 45. The housing main body 39 is provided with a partition wall as integrally formed therewith for partitioning the interior into two spaces, one of which is for the terminal screws 38, 38 and contacts 34, 35 visible in FIG. 17, and the other of which is for torsion coil springs 46, 46 as shown in FIG. 19. This partition wall is provided in a specified direction that subdivides the thickness direction of this terminal device into two portions. This partition wall has a surface 47 on one side whereat the torsion coil spring 46 is disposed, which surface is surrounded by a first barrier 48 extending in the forward/backward direction for partition of the transmitter element 39, and a second barrier 49 elongated in the right/left direction for partitioning the contacts 34, 35. A circular projection 50 is integrally formed near an intersection of these two barriers 48, 49—i.e. at one corner of the surface 47—thus allowing the coil section of torsion coil spring 46 to be attached to the projection 50.

The first barrier 48 is formed with a stopper section at which the distal end of a fixed arm 51 of the torsion coil spring 46 rests whereas the second barrier 49 has a through-going hole allowing the washer guide section 45 to pass through it. A movable arm 52 of the torsion coil spring 46 is latched at its distal end to the tip of washer guide section 45. A stopper section is formed for slidably supporting the same. Note in FIG. 21 that a dash-and-dot line K is used to indicate the center line of a passage for permitting displacement of the washer guide section 45. The projection 50 is disposed at a position spaced apart by a predefined distance D from the passage K of this washer guide section.

Figure 22:
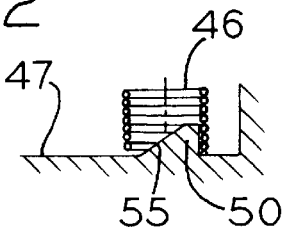
FIG. 22 is a B—B cross-sectional view of the structure of FIG. 21.

As shown in FIG. 22, the circular projection 50 has a slanted plane 55 which is so formed as to be in a direction in which it gets lower relative to the partition wall surface 47 toward the passage side of the washer guide section and have its lower end continued to the surface 47. This slanted plane 55 may advantageously serve along with the surface 47 to facilitate attachment/assembly works of the torsion coil spring 46.

Figure 23:
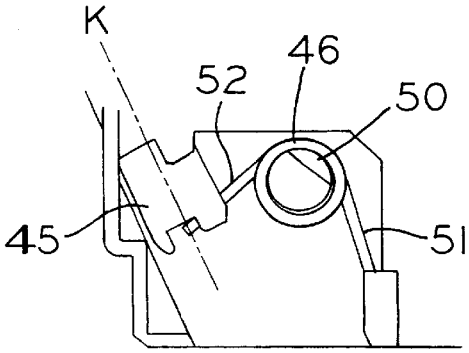
FIG. 23 is a diagram for explanation of an operation of a washer guide section and its associated recovery spring of the terminal device of FIG. 16.
Figure 24A:
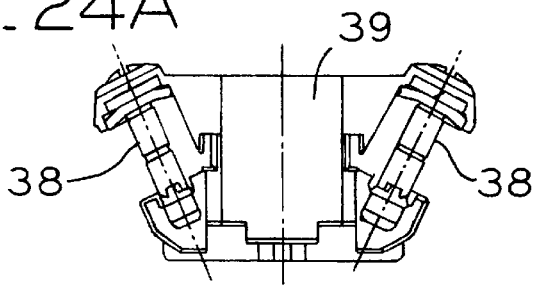
FIG. 24 is a diagram for explanation of assembly process of the terminal device of FIG. 16.
Figure 24B:
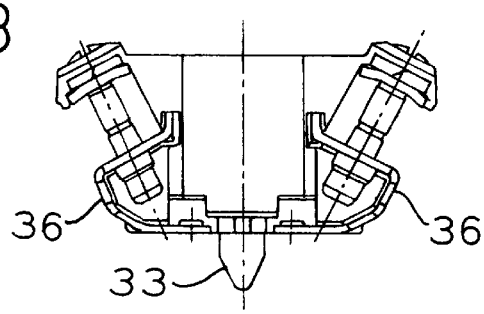
Figure 24C:
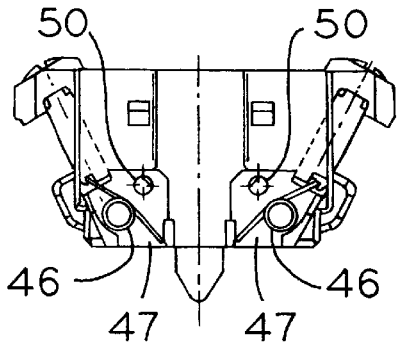
Figure 24D:
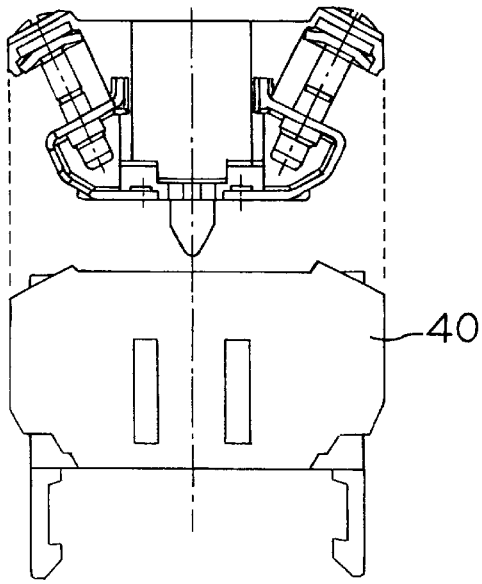

An explanation will next be given of usage of this embodiment. In the recovered state, as shown in FIGS. 17, 19 and 21, the terminal screw 38 is separated together with its washer 44 from the terminal fixture 36 due to presence of a recovery force of the torsion coil spring 46 thereby to define an opening as wide enough to permit insertion of a lead wire or the like between the distal end of terminal screw 38 and the terminal fixture 36. The the lead wire may be inserted from any one of two perpendicular directions: a direction $W_3$ shown in FIGS. 16 and 17, or alternatively, a direction $W_4$ shown in FIG. 16. Once the terminal screw 38 is locked, the washer guide section 46 is likewise displaced causing the torsion coil spring 46 to change in shape as shown in FIG. 23. In cases where the terminal screw 38 is unlocked in order to take out the lead wire or the like, when the terminal screw 38 goes out of the female screw 37 of terminal fixture 36, the device is quickly recovered at its initial or recovered state due to application of the recovery force of the torsion coil spring 46.

FIGS. 24(A) to (D) are diagrams for explanation of an assembly method of the above-mentioned embodiment. The washer-attached terminal screws 38, 38 are set to the housing main body 39 (FIG. 24(A)); then, a contact kit involving the terminal fixtures 36, 36 and transmitter element 39 is attached thereto (FIG. 24(B)). Subsequently, the torsion coil springs 46, 46 are put on the surface 47 under natural conditions (FIG. 24(C)); next, the torsion coil spring 46 is forced to slide on the surface 47 to come closer to the projection 50. With such process steps, the torsion coil spring 46 may be successfully set to the projection 50 as can be seen from FIGS. 19 and 21. Lastly, the main body casing 40 is assembled (FIG. 24(D)) completing the assembly procedure.

See FIGS. 25 to 30, which show a transformer-assisted indicator lamp having a terminal device employing a compression coil spring as its recovery spring in accordance with still another embodiment of the invention.

Figure 25:
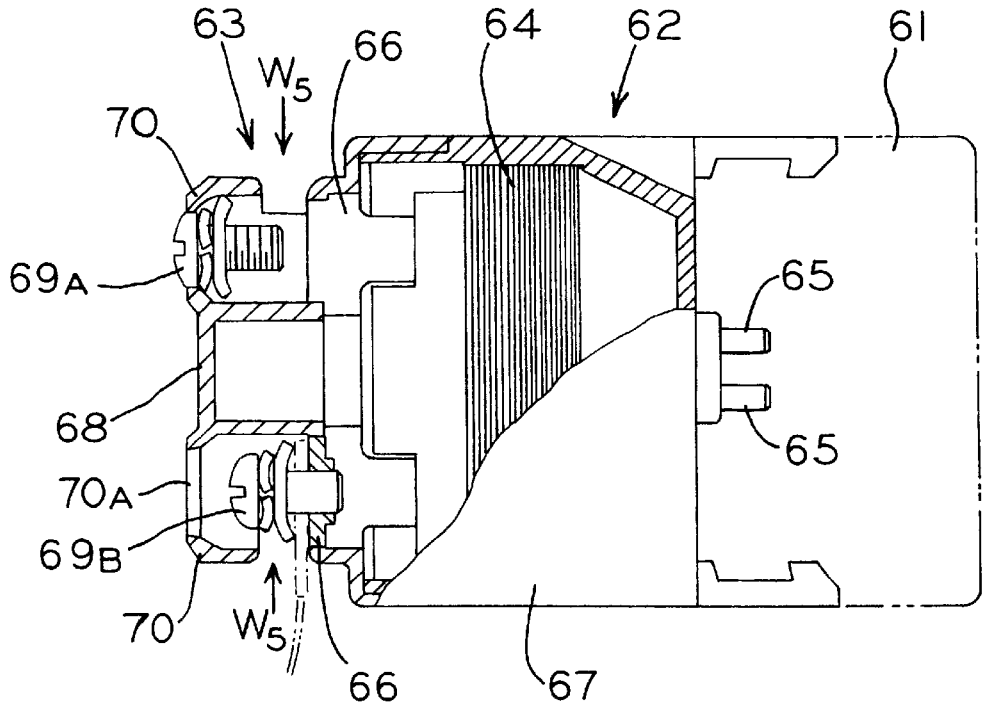
FIG. 25 is a diagram showing in cross-section a transformer-associated indicator lamp in accordance with a further embodiment of the invention.
Figure 26:
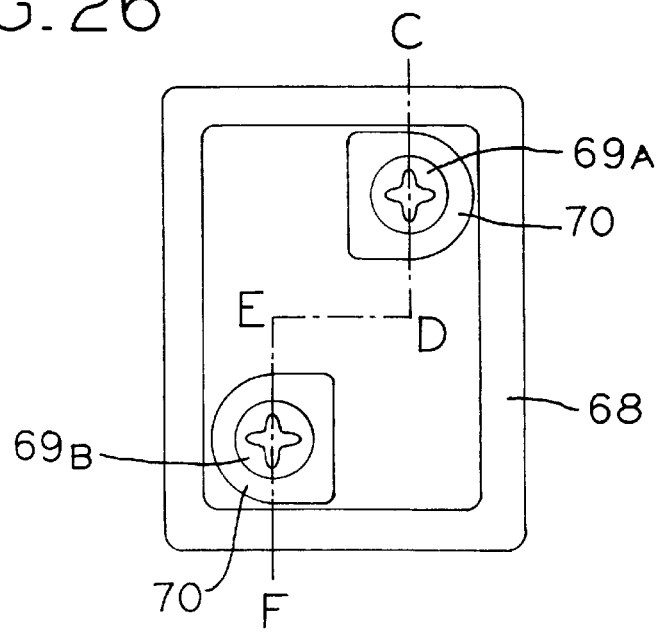
FIG. 26 is a back-surface diagram of the terminal device of FIG. 25.

FIG. 25 shows a cross-section of this transformer-associated indicator lamp (CDEF cross-section of FIG. 26) whereas FIG. 26 depicts a back side view thereof. An indicator section 61 includes an indication section on its front side, and a transformer section 62 is coupled in back of the indicator section 61; in further back of it, a terminal section 63 is provided. The transformer section 62 contains therein a transformer 64 having its primary winding electrically interconnected to terminal fixtures 66, 66 on the back side, and a secondary winding electrically connected to plug-like terminals 65, 65, which are electrically coupled to a light source as built in the indicator section 61, such as a white-heat or incandescent lamp (not shown). The transformer 64 is wrapped by a main body-side housing 67, in back of which a terminal-side housing 68 is coupled by rigid engagement therewith. This terminal-side housing 68 has finger protect sections 70, 70 as integrally formed therewith for covering the head portions of terminal screws 69A, 69B while functioning also as stoppers.

In FIG. 25 the upper terminal screw 69A is in the recovered state defining an opening or gap between the surface of terminal fixture 66 and the distal end plane of terminal screw 69A for permitting insertion of a lead wire or the like. On the contrary, the lower terminal screw 69B is in the locked or clamped state with a lead wire terminal held therebetween. As can be seen from FIG. 26, the two terminal screws 69A, 69B are disposed at selected locations exhibiting point-to-point symmetry in a manner such that all but the top portions of terminal screws are covered by the terminal-side housing 68 including the finger protect sections 70, 70, and that circular driver-insertion holes 70A, 70A permitting rotation of terminal screws are defined at selected portions corresponding to the terminal screw top portions of the finger protect sections 70, 70. With such an arrangement, since in the clamped state each terminal screw is embedded at a position lower than the finger protect section 70, it will no longer happen that a terminal screw acting as a chargeable section is accidentally brought into contact with fingers.

Figure 27:
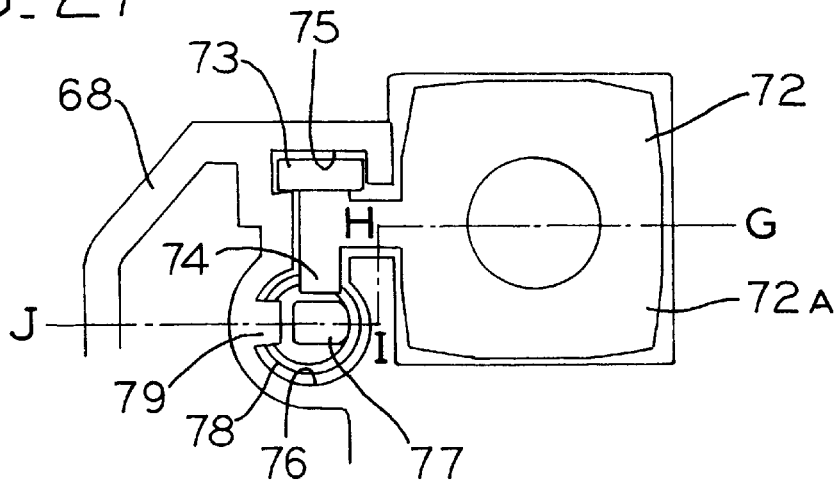
FIG. 27 is an enlarged back-surface diagram of a washer supporting a terminal screw of the terminal device of FIG. 25 along with the nearby section thereof.
Figure 28:
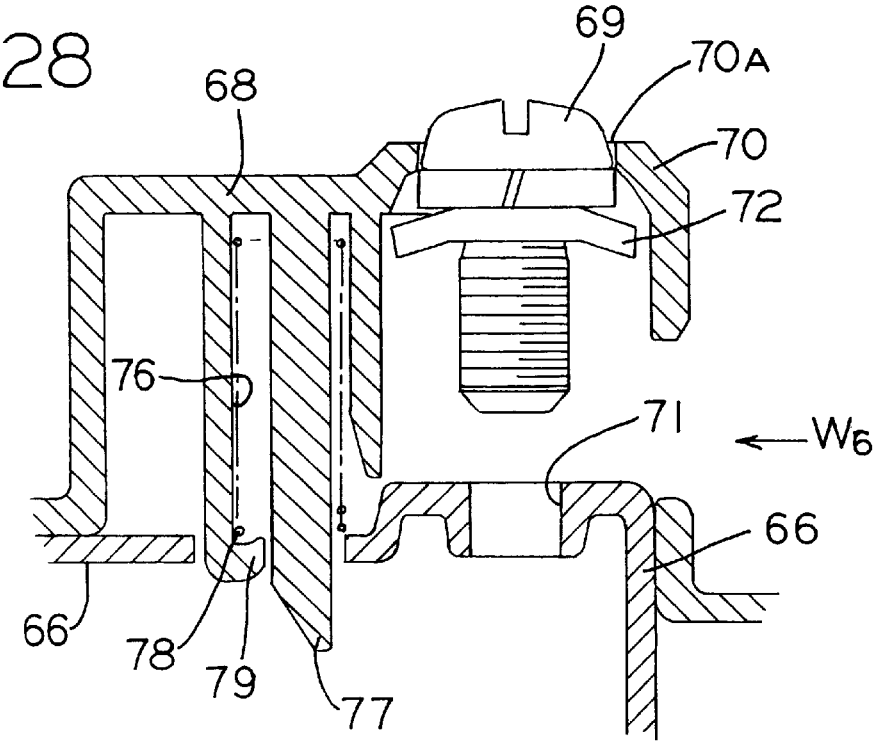
FIG. 28 is a GHIJ cross-sectional diagram of the structure of FIG. 27.

FIG. 27 shows an enlarged back side view of a washer for support of a terminal screw and its nearby section, and FIG. 28 is a GHIJ cross-section of the structure of FIG. 27. Note here that the GH cross-section of FIG. 27 crosses at right angles with the CD cross-section of FIG. 26.

A terminal-side housing 68 is coupled by rigid engagement in back of a main body-side housing 67 while causing two terminal fixtures 66, 66 to be electrically connected to a transformer 64 and also placed on the side of the main body-side housing. A screw hole 71 is defined at each terminal fixture 66 for being mated with a corresponding terminal screw 69. A washer 72 is located in back of the terminal screw 69. A terminal screw 69 is inserted rotatably but unreleasably into a substantially square washer section 72A of the washer 72. A washer guide section 73 of a substantially rectangular shape and spring pressing section 74 are integrally formed at the washer section 72A. The terminal-side housing 68A has a finger protect section 70 formed at the opposite side to the location of indicator section 61 for functioning as a stopper that may define the recovery position of the terminal screw 69. A washer guide groove 75, a cylindrical recovery compression coil spring containment space 76 and a guide bar 77 are integrally formed near the finger protect section 70 on the surface opposing the indicator section 61, wherein the washer guide groove 75 is for causing the washer guide section 73 to displace and slide in a direction parallel with the axis direction of the terminal screw 69, and wherein the guide bar 77 centrally penetrates through the spring containment space 76 and has its forward tip acting as a free end. The foregoing respective parts are coupled with a wall section on the side of the indicator section 61 of terminal-side housing 68.

A latch section 79 is also integrally formed at one part of the front opening section (the position for intersection with terminal fixture 66) of the spring containment space 76 for permitting insertion of a coil spring 78 and yet preventing its release therefrom. The washer guide section 75, spring containment space 76 and guide bar 77 are parallel in axis direction to the terminal screw 69. Characteristically, the length of the washer guide section 73 is short so that it equals to that of the terminal screw 69 whereby it remains free from engagement with the terminal fixture 66.

An explanation will be given of the use method of this embodiment. In the recovered state, as shown in FIGS. 25 and 28, the washer 72 becomes spaced part together with the terminal screw 69 from the terminal fixture 66 due to presence of a restitution force of the coil spring 78 thereby defining a gap wide enough to permit insertion of a lead wire or the like between the distal end of terminal screw 69 and the terminal fixture 66. Note that the lead wire or the like may be inserted from either one of two perpendicular directions $W_5$, $W_6$ shown in FIGS. 25 and 28. In the recovered state a driver tool is inserted into the round hole 70A of finger protect section 70 pressing the terminal screw 69 while the terminal screw 69 is clamped after the distal plane of terminal screw 69 is mated with the screw hole 71 of terminal fixture 66; then, the washer guide section 73 and spring pressing section 74 are likewise displaced (move downward in FIG. 28) compressing the coil spring 78 to ensure that a lead wire is clamped by the terminal fixture 66 and the washer section 72A of washer 72 to come into the clamped state. Where the terminal screw 69 is unclamped in order to take out the lead wire or the like, when the terminal screw 69 goes out of the screw hole 71 of terminal fixture 66, the device is quickly recovered at its recovered state due to application of the recovery force of the coil spring 78.

Figure 29A:
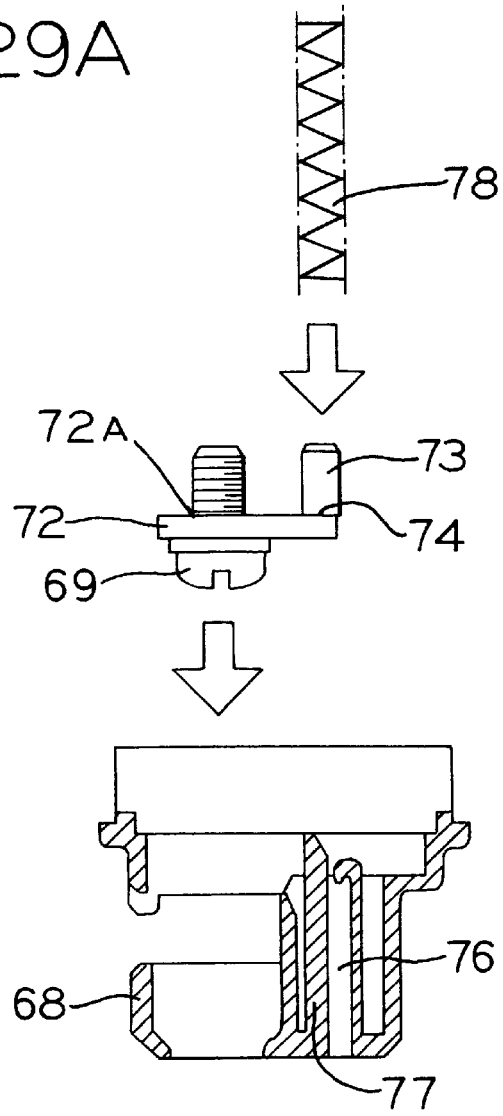
FIG. 29 is a diagram for explanation of assembly process of the terminal device of FIG. 25.
Figure 29B:
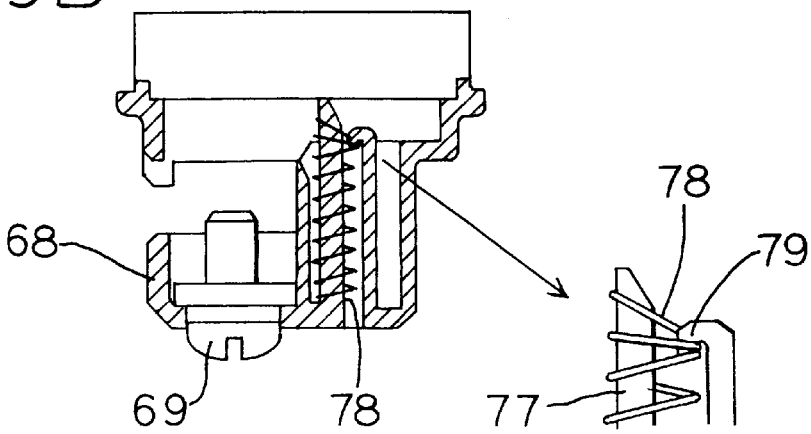

FIGS. 29(A) and (B) show an assembly process sequence of the above embodiment. First, the terminal screw 69 is provided at the washer section 72A of washer 72 in a way such that it remains rotatable but is prevented from releasing or dropping down from it. Then, after the washer guide section 73 of washer 72 is inserted and disposed along the washer guide groove 75 of terminal-side housing 68, the coil spring 78 is provided allowing the guide bar 77 to be placed at the center of coil spring 78 in the spring containment space 76. Next, the coil spring 78 is compressed causing it to reside at the latch section 79 of the spring containment space 76, whereby the terminal screw 69 comes at the recovery position as shown in FIG. 29(B) so that one coil spring 78 is at the spring pressing section 74 whereas the other latches with the latch section 79 in the compressed state. Accordingly, the spring pressing section 74 is compressed by the restitution force of the coil spring 78 allowing the terminal screw 69 to be held at the position of recovered state. Lastly, the terminal-side housing 68 which has been assembled by disposing the washer 72 and coil spring 78 is attached to the main body-side housing 67 which has been separately assembled, thereby completing an intended assembly procedure.

Figure 30A:
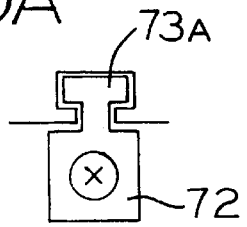
FIG. 30 is a diagram showing one modification of a washer guide section 37 and its associated washer guide groove 75 in the invention.
Figure 30C:
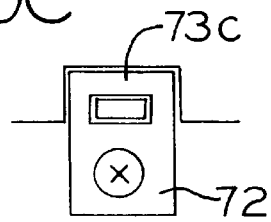
Figure 30B:
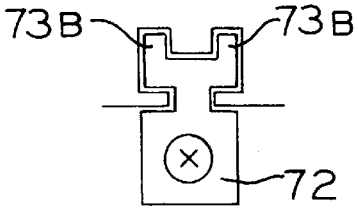
Figure 30D:
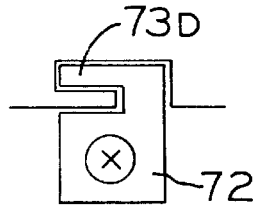

In the invention the washer guide section 73 and washer guide groove 75 as used in the embodiment may be modified in various forms when reduction to practice. Several ones of such modifications are illustrated in FIG. 30. Note in FIG. 30 that while pictorial representation of the coil spring(s) is eliminated, the disposal location of such coil spring may also be fully selectable along with that of the washer guide section. A structure shown in FIG. 30(A) is arranged to provide a T-shaped washer guide section 73A at one side of a square washer 72. Shown in FIG. 30(B) is a structure which further employs L-shaped bent sections 73B at the both sides of the aforesaid T-shape. A structure shown in FIG. 30(C) is arranged by extending one side of the washer 72 into a rectangular shape with its extension part 73C being used as the washer guide section. A structure of FIG. 30(D) is provided with a washer guide section 73D of a hook shape at part of one side of the washer 72.

A further embodiment is shown in FIGS. 31 to 36 which makes use of a torsion coil spring as its recovery spring for a transformer-associated terminal device similar to that shown in FIGS. 25 to 30.

Figure 31:
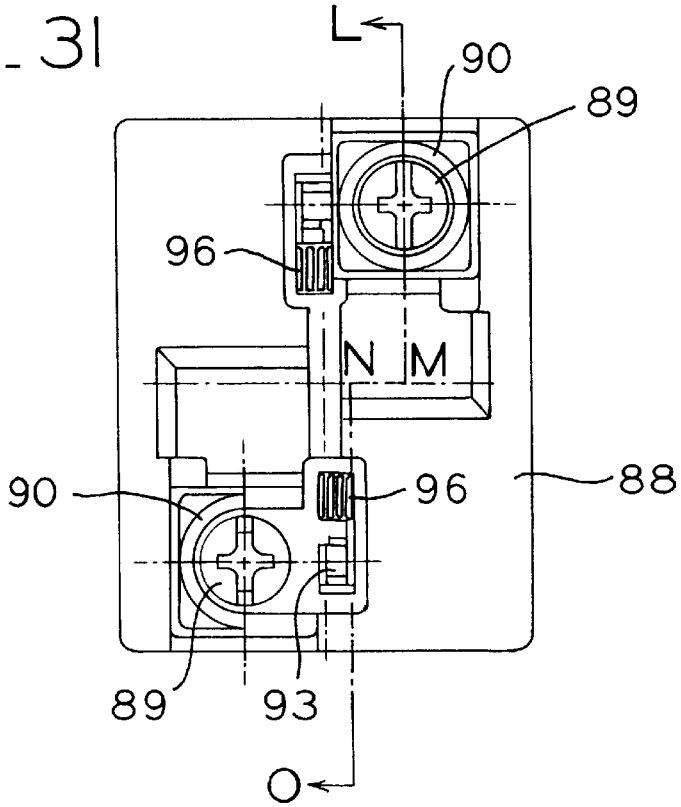
FIG. 31 is a back-surface diagram of a transformer-associated indicator lamp in accordance with a still further embodiment of the invention.
Figure 32:
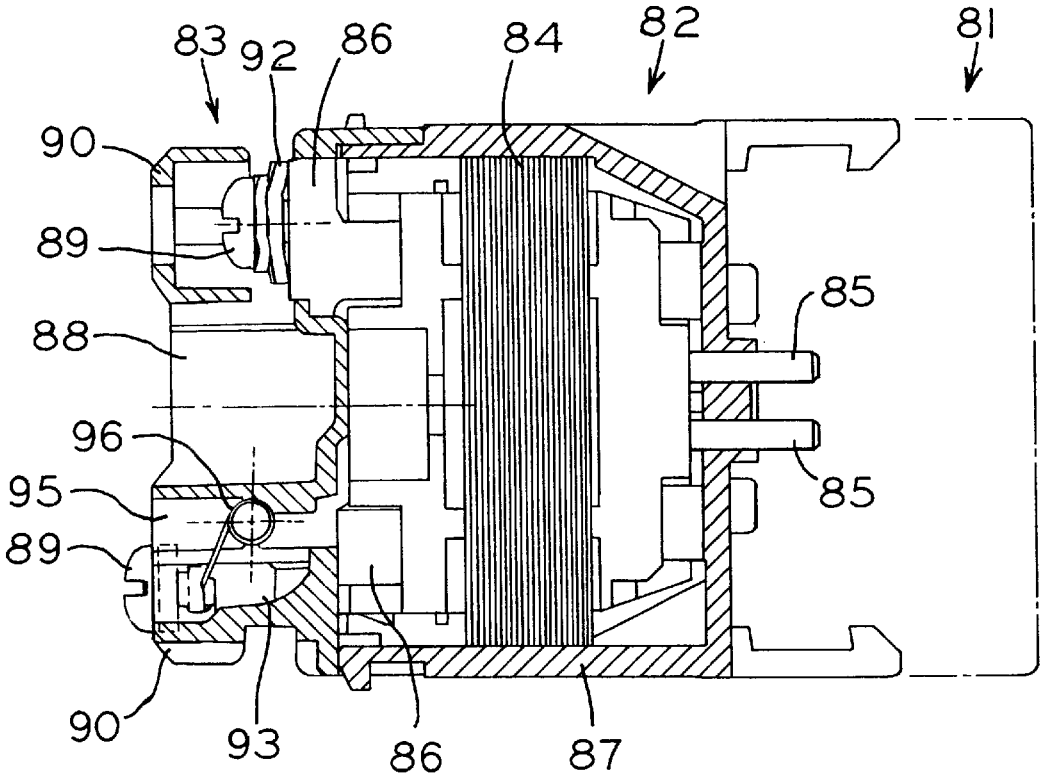
FIG. 32 is an LMNO cross-sectional diagram of the structure of FIG. 31.

FIG. 31 shows a back side view of an example incorporating the invention into the transformer-associated indicator lamp whereas FIG. 32 depicts an LMNO cross-section of the structure of FIG. 31. An indicator section 81 has an indication section on its front side. A transformer section 82 is coupled in back of the indicator section 81; in further back of it, a terminal section 83 is provided. The transformer section 82 includes a transformer 84 with its primary winding electrically interconnected to terminal fixtures 86, 86 on the back side, and a secondary winding electrically connected to plug-like terminals 85, 85, which are electrically coupled to a light source as built in the indicator section 81, such as an incandescent lamp (not shown) by way of example.

The transformer 84 is wrapped by a main body-side housing 87, in back of which a terminal-side housing 88 is coupled by engagement therewith.

This terminal-side housing 88 has finger-protect sections 90, 90 as integrally formed therewith for covering the head portions of terminal screws 89, 89 while functioning also as stoppers. As shown in FIG. 31, the two terminal screws 89, 89 are disposed at selected locations offering point-to-point symmetry in a manner such that all but the top portions of terminal screws 89, 89 are covered by the terminal-side housing 88 including the finger protect sections 90, 90, and that round driver-insertion holes permitting rotation of terminal screws 89, 89 are defined at certain portions corresponding to the terminal screw top portions of the finger protect sections 90, 90. With such an arrangement, since in the clamped state the terminal screws 89, 89 are embedded at a position lower than the finger protect section 90, it will no longer occur that these terminal screws 89, 89 each acting as a chargeable section are accidentally contacted with fingers.

A washer 92 for supporting the terminal screw 89 is of a substantially square shape: It has one side at which a down-standing piece is formed to be bent at right angles toward the terminal fixture thus forming a washer guide section 93. This washer guide section 93 is displaceable and slidable in the axis direction of the terminal screw 89 along a washer guide groove 94 as formed in the terminal-side housing 88. The terminal-side housing 88 is formed with a recovery torsion coil spring containment space 95 which is adjacent to the washer guide groove 94 and is open at its back plane for allowing a torsion coil spring 96 to be held within this spring containment space 95.

Figure 33:
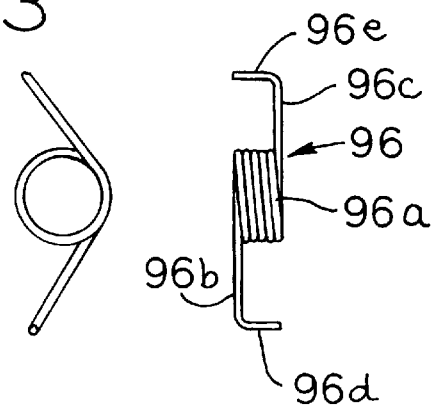
FIG. 33 depicts a back side view (A) and its side view (B) of a recovery spring adaptable for use in the terminal device of FIG. 31.

As shown in FIG. 33, the torsion coil spring 96 is configured under free condition so that it has a coil section 96*a* and two arm sections 96*b*, 96*c*, wherein the tip of each arm section is bent orthogonally forming a stopper distal end section 96*d*, 96*e*. This torsion coil spring 96 exhibits point-symmetry and has no direction-dependency.

Figure 34:
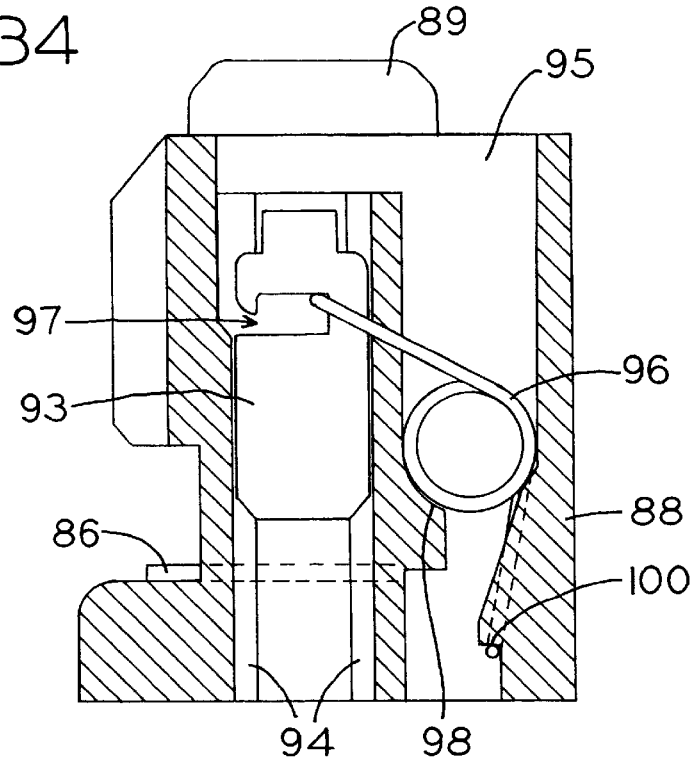
FIG. 34 is a partly enlarged illustration of the recovery spring and its nearby section of the terminal device of FIG. 31.

A partially enlarged view of the torsion coil spring 96 is shown in FIG. 34 along with its nearby section. The washer guide section 93, which is movable together with the washer 92 as embedded in the head section of an associative terminal screw, attempts to positionally change or move in a direction parallel with the axis direction of the terminal screw under control of the washer guide groove 94 formed in the housing. FIG. 34 shows the recovered state farthest from the terminal fixture 86: At this time, a sufficient gap is defined which is wide enough to permit insertion of a lead wire or the like between the distal end of terminal screw 89 and the terminal fixture 86. A cut-away portion 97 is formed at certain location on a side surface as distant far from the torsion coil spring 96 of the washer guide section 93 thus allowing the movable arm section 96*c* of torsion coil spring 96 to rest here at its hook-shaped distal end section 96*e*.

The spring containment space 95 may consist of a hold section of a semicylindrical shape for accepting and holding therein the coil section 96*a* of torsion coil spring 96, and an installation passage 99 having an opening on the housing back side for accommodation of the torsion coil spring 96 into the hold section 98. A stopper section 100 is formed at certain location on a side surface distant far from the washer guide groove 94 of holder section 98, causing the fixed arm section 96*d* of torsion coil spring 96 to rest thereon at its distal end section 96*d* to thereby eliminate any accidental release therefrom. The movable arm section 96*c* of torsion coil spring 96 may be displaced with a change in position of the washer guide section 93; the torsion coil spring 96 operates to continuously apply to the washer guide section 93 a specific force which pushes it backward.

Figure 1:
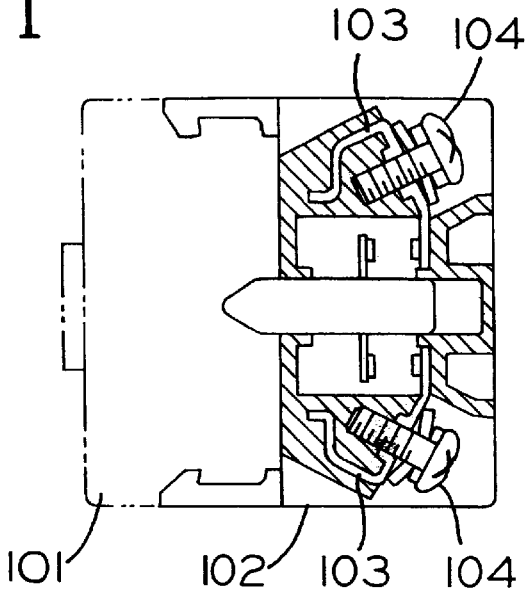
FIG. 1 Shows a push button switch which is one prior art of the present invention.
Figure 2:
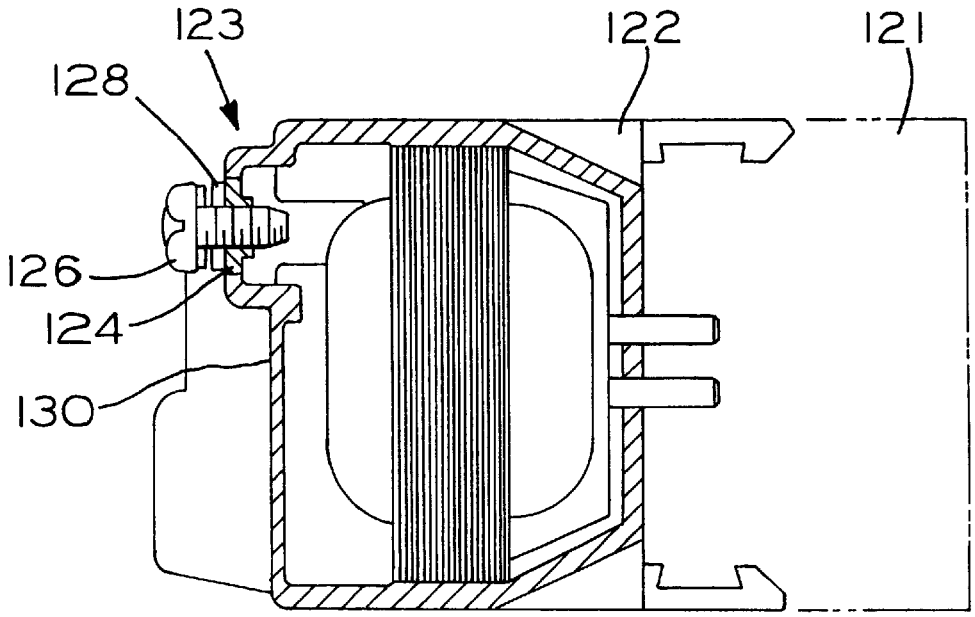
PRIOR ART FIG 2
FIG. 2 is a diagram showing in partial cross-section a side view of a transformer-attached indicator lamp which is another prior art of the invention.
Figure 3:
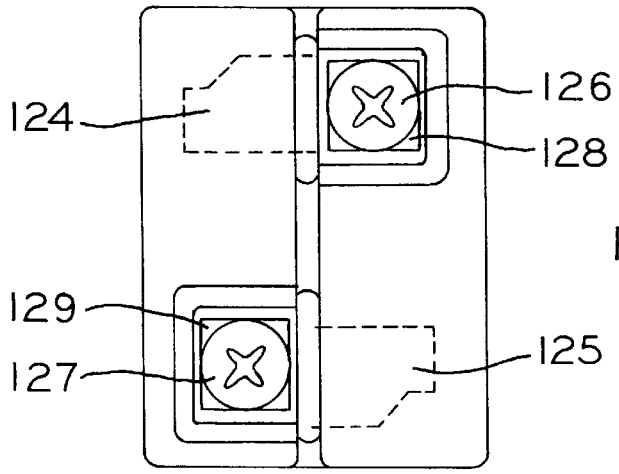
FIG. 3 is a partial cross-sectional view of the back side of the transformer-attached indication lamp of FIG. 2.
Figure 4:
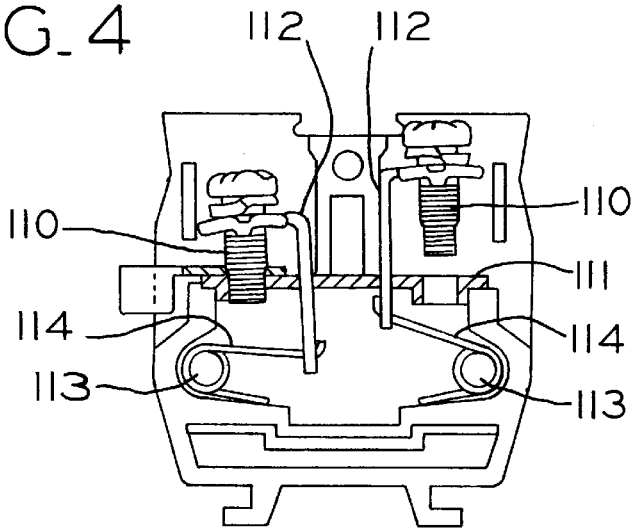
PRIOR ART FIG 4
FIG. 4 shows a terminal device as still another prior art of the invention.
Figure 5:
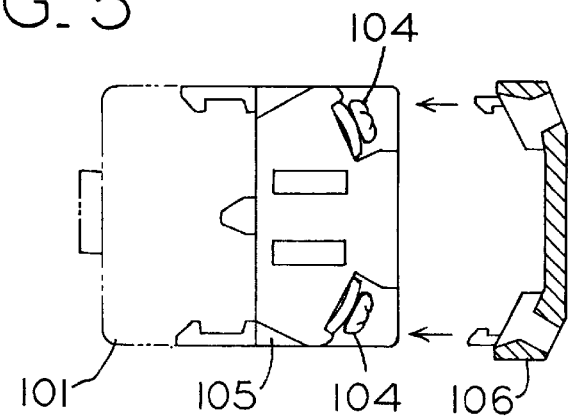
PRIOR ART FIG 5
FIG. 5 depicts yet another prior art of the invention.
Figure 6:
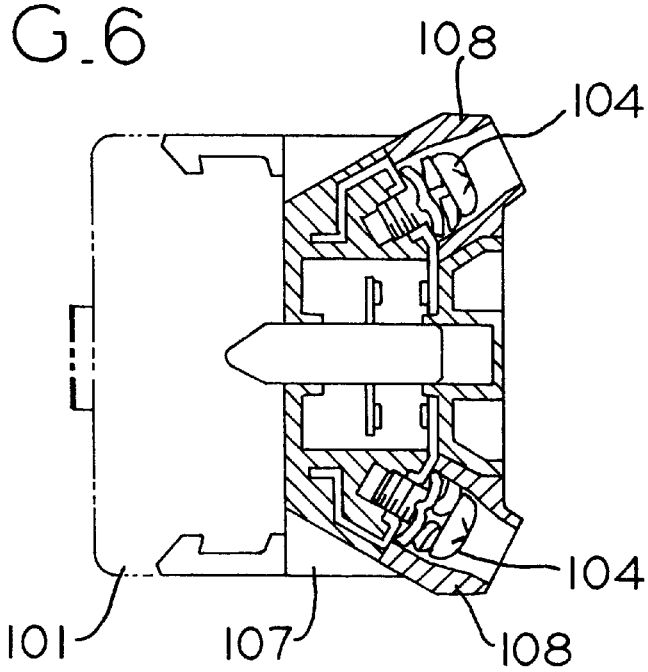
FIG. 6 depicts a further prior art of the invention.

Very importantly, as apparent from viewing FIG. 34, the position of the torsion coil spring 96 is in back of the location of the screw hole as provided at the terminal fixture 86. Accordingly, the stopper point with the torsion coil spring 96 as provided at the washer guide section 93 is near or around the washer 92 causing the washer guide section 93 to decrease in dimension in the forward/backward direction. By way of example, with the prior art shown in FIG. 4, the washer guide section is increased in size due to the fact that the torsion coil spring 114 is disposed along an extension line from the axis direction of the terminal screw 110 whereas the washer guide section 112 is supported so that it penetrates the terminal fixture 111 even in the state that the terminal screw 110 is placed at a position farthest from the terminal screws 111. Also importantly, the direction of a line connecting bending points of the washer 92 and washer guide section 93 is at right angles to the axis direction of torsion coil spring 96. For instance, in the prior art shown in FIG. 4, the two directions are in parallel with each other. These characteristics of the invention may greatly contribute to a reduction in depth dimension of the terminal device as a whole.

Figure 35:
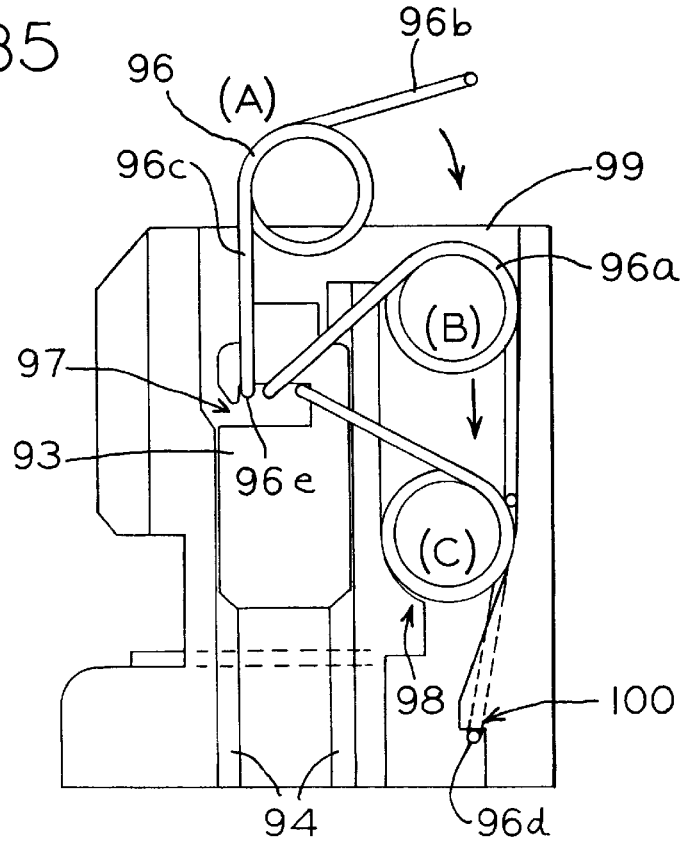
FIG. 35 is a diagram for explanation of one exemplary assembly method of the recovery spring in the terminal device of FIG. 31.

An assembly method of the torsion coil spring 96 is shown in FIG. 35. First, the washer guide section 93 which is formed at the washer 92 of terminal screw 89 is inserted into the washer guide groove 94 from the front side of the terminal-side housing 88 causing the head section of the terminal screw 89 to be brought into contact with the finger protect section 90. Next, latch the distal end portion 96*e* of the movable arm section 96*c* of torsion coil spring 96 at the cut-away portion 97 as formed in the washer guide section 93 (at step A); insert it into the installation passage 99 upon application of a twist to the fixed arm section 96*b* (at step B); then push the coil section 96*a* deeply thereinto forcing the distal end section 96*d* of fixed arm section 96*b* to latch at the stopper section 100 while letting the coil section 96*a* be held in holder section 98.

Figure 36A:
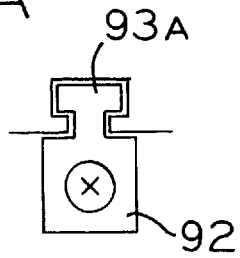
FIG. 36 is a diagram showing a modification of the washer guide section and washer guide groove of this invention.
Figure 36C:
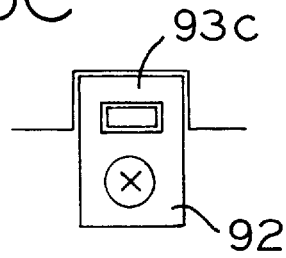
Figure 36B:
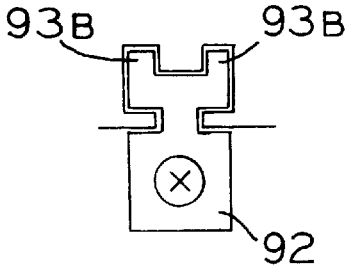
Figure 36D:
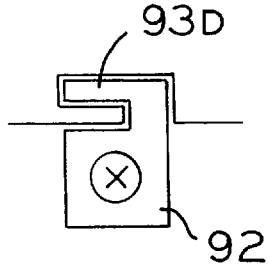

The washer guide section 93 and washer guide groove 94 of the invention may be modified in a variety of ways when reduction to practice. Some of such modifications are illustrated in FIG. 36. A structure shown in FIG. 36(A) employs a T-shaped washer guide section 93A provided at one side of a square washer 92. Depicted in FIG. 36(B) is a structure which further employs L-shaped bent sections 93B at both sides of the aforesaid T-shape. A structure of FIG. 36(C) is configured by extending one side of the washer 92 into a rectangular shape with its extension part 93C used as the washer guide section. A structure of FIG. 36(D) comes with a hook-shaped washer guide section 93D at part of one side of the washer 92.

Some advantages of this invention are as follows.

(1) It is possible, when no leads are wired, to immediately insert a lead into a gap space as defined on or above the terminal fixture due to the fact that the recovered state is established upon application of the force of a recovery spring; conversely, even where such lead is to be taken out, unlocking the terminal screw may enable attainment of automatic recovery to the recovered state due to the presence of such recovery spring force. Consequently, the wiring process steps can be reduced in number while enhancing the efficiency of wiring works even when close contact attachment is done for the device.

(2) It will no longer take place that the terminal screws accidentally drop down or are lost because of the fact that in the recovered state each terminal screw and washer guide section are firmly supported at either the housing or the terminal fixture.

Especially, the terminal device as recited in claim 6 can be almost completely free from the risk of dropping and missing of terminal screws since in the recovered state the terminal screws are held as they continue to be in the recovered state by assistance of the stopper function of the finger protect section of the housing.

(3) Since the finger protect section is formed to be integral with the housing main body, the number of necessary parts or components is reduced while eliminating any accidental release thus retaining increased safety.

(4) The terminal device of claim 19, 21, 23 or 24 is:

(4-1) Decreased in depth of entire product due to the fact that the movable end of a recovery spring is fixed at a midway portion of the back surface of the washer guide section, reducing the length spanning from the terminal screw head section to the fixed end of recovery spring.

(4-2) In safety and free from the risk of occurrence of a direct contact of leads and/or solderless terminals with the recovery spring because of the fact that disposing the recovery spring in back of the washer guide section renders such recovery spring invisible from the lead insertion side.

(4-3) Capable of causing the recovery spring to extend and shrink in the upward/downward directions regardless of the female screw position due to the fact that the axis center of terminal screw and the recovery spring are disposed in parallel with the washer guide section being placed therebetween, and also of attaining reliable and smooth up-and-down movements of the terminal screw because of the capability of providing sufficient guide length.

(4-4) Capable of rendering assembly works easier while increasing adaptability to automation of fabrication process steps because during assembly the recovery spring is inserted into a predefined space under natural conditions without applying thereto any pressure in advance while providing an intended compressive force during attachment of the main body casing.

(5) The terminal devices of claims 25, 27, 28 or 29 are:

(5-1) Capable of reducing the depth dimension of the devices because the housing partition wall is provided for subdividing the thickness direction of terminal device while disposing the trunk portion of a terminal screw and the recovery screw on the opposite front and back sides thereof.

(5-2) Capable of avoiding the need of decreasing the width length of a terminal fixture and forming an opening for intersection while reducing the thickness of terminal device. This can be said because the washer guide section is structured to extend for intersection along the side edge of such terminal fixture.

(5-3) Capable of facilitating assembly works while enhancing adaptability to automatic assembly machines. This can be said because, during assembly, attachment to a projection is attainable by merely putting the recovery spring onto the surface of the partition wall in free state with no pressurization given thereto, and then sliding the coil section along the surface.

(5-4) Capable of facilitating assembly works and its automation. This is attainable because it will no longer happen that the coil section goes excessively beyond the projection. This is originated from the fact that during sliding movements of the coil section, a projection is provided at a near-the-intersection corner of a barrier forming the boundary of surface to ensure that when the moving coil section is attached to such projection, two arm sections of a torsion coil spring are also brought into contact with the barrier to be held in a specified state.

(6) The terminal devices of claims 30 to 33 are:

(6-1) Capable, due to parallel disposal of the washer guide section and spring pressing section at the washer for support of a terminal screw, of shortening the length of such washer guide section at a level equivalent to the length of terminal screw while allowing the recovery spring to fall within an allowable terminal-screw displacement range even when such spring is sufficiently elongated, which in turn leads to the capability of almost equalizing the overall depth size to prior art products.

(6-2) Capable of ensuring that a compression coil spring does no longer shrink even upon application of a compressive force thereto thus enabling efficient reaction of the restitution force while facilitating automated assembly. This is because a specific guide bar is provided at the axis center portion of the recovery compression coil spring containment space.

(6-3) Capable of rendering automatic assembly easier due to the fact that since a latch section is provided at the front edge section of the recovery compression coil spring containment space, the compression coil spring does never jump out toward the outside during assembly, and that assembly may be completed by simply engaging the main body section and terminal section together after separate assembly of a respective one of the both.

(7) The terminal devices of claims 34 to 37 are:

(7-1) Capable of involving a built-in automatic terminal-screw recovery mechanism without having to let the overall depth dimension of such terminal devices increase beyond that of prior art products.

(7-2) Capable of easing assembly works because the recovery torsion coil spring containment space is opened with respect to the back surface of the terminal-side housing while permitting completion of a recovery spring assembly step merely by causing the distal end portion of one arm of the torsion coil spring to be latched at the cut-away portion of the washer guide section with the arm distal end portion of the remaining arm section sliding along the side surface within the spring containment space. This may also facilitate automation of assembly process steps.

What is claimed is:

1. A terminal device comprising a housing main body, a terminal fixture held by the housing main body, and a washer-having terminal screw mated with a female screw formed in the terminal fixture, wherein the washer has a washer guide section on its one side, and the washer guide section bends from the side of the washer toward the terminal fixture and extends in parallel with an axis of the terminal screw, and a return spring is provided on one side of the washer guide section and the terminal screw is disposed on an opposite side of the washer guide section, whereby the washer guide section is interposed between the return spring and the terminal screw, and one end of the return spring is stopped at the washer guide section.

2. A terminal device according to claim 1, wherein a finger protect section having a stopper function for the terminal screw is integrally formed with the housing main body.

3. A terminal device according to claim 1, wherein the return spring is a compression coil spring.

4. A terminal device according to claim 3, comprising a main body casing attached to the housing main body, wherein the compression coil spring is contained in a spring containment section formed in the housing main body, and the main body casing is attached to the housing main body to assemble the compression coil spring into a compressed state.

5. A terminal device according to claim 1, comprising a main body casing attached to the housing main body, and an operation section to which the main body casing is detachably coupled, wherein the housing main body has: a movable contact point capable of being turned on and off with respect to a fixed contact point provided to the terminal fixture; and a transmitter element for opening and closing the contact point in accordance with an operation at the operation section.

6. A terminal device according to claim 5, wherein the return spring is placed between a front wall of the main body casing brought into contact with the operation section, and a stopper formed in the washer guide section.

7. A terminal device comprising a housing main body, a terminal fixture held by the housing main body, and a terminal screw with washer mated with a female screw formed in the terminal fixture, wherein a washer guide section is provided at one side of the washer, and the washer guide section bends from the side of the washer and toward the terminal fixture and extends in parallel with an axis of the terminal screw, and the housing main body includes a partition wall for dividing the housing main body into two sections in a direction of the thickness thereof, and a return torsion coil spring is provided on one side of the partition wall and the terminal screw is disposed on an opposite side of the partition wall, whereby the partition wall is interposed between the return torsion coil spring and the terminal screw, and one end of the return torsion coil spring is stopped by a distal end portion of the washer guide section.

8. A terminal device according to claim 7, wherein a finger protect section having a stopper function for the terminal screw is formed to be integral with the housing main body.

9. A terminal device according to claim 7, wherein the partition wall has a projection on its surface for allowing the coil section of the torsion coil to be attached thereto, and an end surface of the projection is formed as a surface slanted from the surface of the partition wall.

10. A terminal device according to claim 9, wherein the partition wall has a barrier for keeping the coil section from excessively going over the projection when the coil section of the torsion coil spring is slid on the surface of the partition wall to be attached to the projection.

11. A terminal device according to claim 7, comprising a main body casing attached to the housing main body, and an operation section to which the main body casing is detachably coupled, wherein the housing main body has a movable contact point capable of being turned on and off with respect to a fixed contact point provided to the terminal fixture, and a terminal transmitter for opening and closing the contact point in accordance with an operation at the operation section is provided.

12. A terminal device comprising a terminal-side housing provided in back of a main body-side housing of electrical equipment, a terminal fixture contained in the terminal-side housing, a terminal screw mated with a screw hole formed in the terminal fixture, and a washer for supporting the terminal screw, wherein the terminal-side housing has a washer guide groove and a spring containment space in parallel with an axial direction of the terminal screw, a return compression coil spring is contained in the spring containment space, and the washer is integrally formed with a washer guide section which travels in the washer guide groove, and a spring compression section which projects in the spring containment space to compress the return compression coil spring.

13. A terminal device according to claim 12, wherein a finger protect section is formed to be integral with the terminal-side housing.

14. A terminal device according to claim 12, wherein a guide bar penetrating an axial center of the return compression coil spring is provided in the spring containment space.

15. A terminal device according to claim 12, wherein a latch section for permitting the return compression coil spring to be inserted into the spring containment space and for preventing the return compression coil spring from escaping therefrom at the front edge opening section of the spring containment space is provided.

16. A terminal device comprising a terminal-side housing provided in back of a main body-side housing of electrical equipment, a terminal fixture contained in the terminal-side housing, a terminal screw mated with a screw hole formed in the terminal fixture, and a washer for supporting the terminal screw, wherein the terminal-side housing has a washer guide groove and a spring containment space in parallel with an axial direction of the terminal screw;

the spring containment space contains a return torsion coil spring;

the washer is integrally formed with a washer guide section which travels in the washer guide groove; and one end of the return torsion coil spring is stopped at the washer guide section.

17. A terminal device according to claim 16, wherein the terminal-side housing is integrally formed with a finger protect section.

18. A terminal device according to claim 16, wherein the spring containment space has an opening at the back face of the terminal-side housing, and the return torsion coil spring is contained in the spring containment space through the opening.

19. A terminal device according to claim 16, wherein a stopper edge section which is bendable at right angle is provided at a distal end portion of the movable arm of the return torsion coil spring, and the stopper edge section is stopped at a cut-way section formed in the washer guide section.

* * * * *